US011970356B1

(12) United States Patent
Haag

(10) Patent No.: US 11,970,356 B1
(45) Date of Patent: Apr. 30, 2024

(54) WIRE SPOOL COVER

(71) Applicant: Robert Haag, North Bend, OR (US)

(72) Inventor: Robert Haag, North Bend, OR (US)

( * ) Notice: Subject to any disclaimer, the term of this patent is extended or adjusted under 35 U.S.C. 154(b) by 136 days.

(21) Appl. No.: 17/866,464

(22) Filed: Jul. 15, 2022

Related U.S. Application Data

(63) Continuation-in-part of application No. 17/478,822, filed on Sep. 17, 2021, now Pat. No. 11,407,609.

(51) Int. Cl.
*B65H 57/18* (2006.01)
*B65H 49/18* (2006.01)

(52) U.S. Cl.
CPC ..... *B65H 57/18* (2013.01); *B65H 49/18* (2013.01)

(58) Field of Classification Search
CPC ..... B65H 57/18; B65H 49/18; B65H 57/00; B65H 57/04; B65H 2402/41
See application file for complete search history.

(56) References Cited

U.S. PATENT DOCUMENTS

| | | | | |
|---|---|---|---|---|
| 1,726,137 | A * | 8/1929 | Bernal | B65H 75/141 242/396.5 |
| 3,283,892 | A | 11/1966 | Rosen | |
| 3,698,546 | A | 10/1972 | Kass | |
| 5,222,683 | A * | 6/1993 | Blackshire | B65H 49/28 242/129 |
| 5,516,059 | A * | 5/1996 | Gudgeon | B65H 49/18 242/566 |
| 5,593,035 | A * | 1/1997 | Taylor | B65H 16/005 206/397 |
| 7,252,262 | B2 | 8/2007 | Oku et al. | |
| D712,749 | S | 4/2014 | Robertson | |
| 11,407,609 | B1 * | 8/2022 | Haag | B65H 75/141 |
| 2003/0089818 | A1 | 5/2003 | Reau et al. | |
| 2007/0210131 | A1 | 9/2007 | Yarborough et al. | |
| 2011/0024547 | A1 * | 2/2011 | Parks | B65H 57/08 242/615.3 |

FOREIGN PATENT DOCUMENTS

| | | |
|---|---|---|
| CN | 200530035771.6 | 4/2005 |
| JP | 3001174 U | 8/1994 |
| PL | 004732840-0004 | 12/2018 |

OTHER PUBLICATIONS

Genuine Bosch Art 23 26 30 Combitrim Easytrim Strimmer / Grass Trimmer Pro-Tap Automatic Spool Line + Cover (8m, F016L71088 + F016800175), www.OnBuy.com, at least as early as Jan. 5, 2021, Internet WWW, https://www.onbuy.com/gb/genuine-bosch-art-23-26-30-combitrim-easytrim-strimmer-grass-trimmer-pro-tap-automatic-spool-line-cover-8m-f016l71088-f016800175~c11492~p7467178/.

Ultradry Spool Holders, www.thingiverse.com/thing:2352833, Jun. 12, 2017, Internet WWW, https://www.thingiverse.com/thing:2352833.

* cited by examiner

*Primary Examiner* — William A. Rivera
(74) *Attorney, Agent, or Firm* — Howard Russell, Attorney at Law

(57) ABSTRACT

Embodiments of spool covers adapted for covering spools of wire mounted on corresponding shafts for preventing tangling of the wire during use, comprising a first cover portion and a second cover portion, each cover portion adapted to engage the shaft adjacent sides of the spool of wire without removing the spool from the shaft, the first and second cover portions being one of rebuildable, comprised of disposable cardboard, and comprised of side walls wherein one of the side walls has attached thereto at least one collett portion adapted for retaining the spool centered within the first and second cover portions.

18 Claims, 21 Drawing Sheets

WIRE SPOOL COVER

CROSS REFERENCE TO RELATED APPLICATION

This patent application is a continuation-in-part patent application which claims the priority and benefit of U.S. patent application Ser. No. 17/478,822, filed 17 Sep. 2021.

FIELD OF THE INVENTION

The present invention relates to a device for use in covering a wire spool in order to prevent the wire from getting tangled as it is pulled off the spool, and in particular to embodiments of rebuildable spools covers and limited, or single use, easy-to-use spool covers adapted for use with a wire spool while it is on a spool mounting shaft, or other spool caddy, to avoid tangling of wire on the spool or the shaft, and to avoid tangling with other spools of wire that may be arranged in close proximity on the shaft.

BACKGROUND OF INVENTION

The construction of buildings, residential or commercial, has included the distribution, placement, and mounting of a variety of wires, including, as examples, electrical wire, speaker wire, coaxial cables for television signals, network cabling, connection for security sensors, and HVAC sensors and controls. The wires have been commonly provided on metal or plastic spools with a circular opening adapted for mounting on a horizontal shaft where the spool can easily rotate in order to facilitate the dispensing of the wire as it is pulled from the spool.

The wiring has been installed by skilled workers who pull the wire from the spool as needed, often at longer distances from the spool. As wire has been pulled by the installer, the inertia of the rotating spool has released more wire than has been needed, causing excess wire to accumulate around an area of the spool where it has become tangled. When this has happened, the installer has been required to interrupt their work of installation and has had to return to the location of the spool to disentangle the wire, thus slowing the process of installation. This has especially been a problem when more than one wire spool is being used at the same time. For example, four or more spools of wire may be on the same spool caddy and be simultaneously pulled through one conduit.

Thus, to date, the installer has had to exercise a great deal of caution in the rate at which the wire has been pulled from the spool, or spools, in order to reduce the likelihood of entangling the wire, and this has also slowed down the process of pulling wire and has diverted the attention of the installer from the actual work of mounting and installation of the wire. Often, at least one additional worker has been needed to watch the wire to ensure the wires have not become entangled as the installer has pulled wire from the spool. Learning to keep the wire from tangling has been considered to be one of the more difficult skills for an apprentice to learn. Therefore, there has been needed a device that would be easy to use and would accomplish the containment of the spooled wire to avoid tangling, while also allowing the installer to pull wire as needed without slowing their work.

Prior spool covers, such as the spool cover found in International Publication WO96/25349, to Tiecken, is for a larger spool of wire (such that it is not adapted for use with other spools of wire on a single portable spool rack system).

Tiecken includes closed ring-shaped shaft stubs 28, 29, which are mounted to and supported by side walls 24, 26, and which require users to remove the spool of wire from its shaft in order to remove the spool of wire from the spool rack or wire spool caddy.

Further, prior spool covers have worn and broken relatively quickly, and so accordingly there had developed a need for sturdier spool covers capable of being refurbished and/or to provide a spool cover that is readily recyclable or disposable (i.e., is made out of cardboard or paper) which would cause minimal harm to the environment if disposed of.

SUMMARY OF THE INVENTION

In accordance with an aspect and embodiment of the disclosure, there is provided a wire spool cover adapted for covering a spool of wire. The spool has opposing sides (also known as flanges) and a central hollow (also known as an arbor hole) tube (also known as a barrel) forming the spool and is adapted to be mounted on a shaft with the shaft passing through the central hollow tube. The wire spool cover is adapted for preventing tangling of the wire during use of the spool of wire on the shaft and comprises a first cover portion adapted to partially encompass a portion of the spool of wire. The first cover portion comprises an outer wall and at least one side wall. There is also provided a second cover portion adapted to partially encompass another portion of the spool of wire. The second cover portion comprises an outer wall and at least one side wall. The at least one side wall of the first cover portion and the at least one side wall of the second cover portion are each adapted to attach to the shaft adjacent an opposing side of the spool of wire without removing the spool of wire from the shaft.

The at least one side wall of the first cover portion preferably comprises a plurality of opposing side walls that are perpendicularly attached to the outer wall of the first cover portion. The at least one side wall of the second cover portion preferably also comprises a plurality of opposing side walls that are perpendicularly attached to the outer wall of the second cover portion.

Preferably, the first cover portion and the second cover portion are positionable to each partially encompass the spool of wire so at least one edge of the outer wall of the first cover portion and at least one edge of the outer wall of the second cover portion align. The at least one side wall of the first cover portion preferably comprises a particularly shaped mating portion that matingly fits with a complementarily shaped mating portion on the at least one side wall of the second cover portion such that the first cover portion and the second cover portion combine to form the spool cover around the spool of wire.

The at least one side wall of the first cover portion and the at least one side wall of the second cover portion may preferably be at least semi-circular in shape. However, other shapes known in the art may be used. The outer wall of the first cover portion and the outer wall of the second cover portion may preferably be each half cylindrical in shape, so when aligned and combined, the first cover portion and the second cover portion form the spool cover with a cylindrical shape. Other shapes known in the art may be used for the spool cover shape and the outer wall shapes.

The first cover portion and the second cover portion may comprise a plurality of cover portions adapted for enclosing the spool of wire mounted on the shaft without requiring clasps, hinges, pins or other hardware to connect the plurality of cover portions to each other.

The particularly shaped mating portion of the at least one side wall of the first cover portion may preferably be at least one particularly shaped protrusion and the complementarily shaped mating portion of the at least one side wall of the second cover portion may preferably be at least one complementarily shaped indentation. In such embodiment, the at least one particularly shaped protrusion matingly fits into the at least one complementarily shaped indentation when the first cover portion and the second cover portion are aligned such that the first cover portion and the second cover portion combine to form the spool cover. Thus, for example, if the particularly shaped mating portion of the at least one side wall of the first cover portion is a square protrusion, then the complementarily shaped mating portion of the at least one side wall of the second cover portion is a square indentation and the square protrusion would matingly fit into the square indentation. The particularly shaped mating portion and the complementarily shaped mating portion may be any shape known in the art, including a square or rectangle shape, triangular shape, circular or partially circular shape, or an elliptical or partially elliptical shape. Further, the protrusion and indentation may be part of either the first or second cover portions, or partly on both, without departing from the scope of the invention as claimed.

The at least one complementarily shaped indentation of the at least one side wall of the second cover portion may be formed by a complementarily shaped layer of material attached between a portion of the outer wall of the second cover portion and a portion of the side wall of the second cover portion. Thus, the at least one particularly shaped protrusion of the at least one side wall of the first cover portion may matingly fit between the portion of the outer wall of the second cover portion and the portion of the side wall of the second cover portion, and an edge of the at least one particularly shaped protrusion of the at least one side wall of the first cover portion may matingly align with the complementarily shaped layer of material when the at least one particularly shaped protrusion of the side wall of the first cover portion is pushed into the at least one complementarily shaped indentation of the at least one side wall of the second cover portion.

The second cover portion preferably further comprises an opening on the outer wall adapted for allowing the wire on the spool to pass through the outer wall of the second cover portion, allowing the spool of wire to rotate freely on the shaft while encompassed by the spool cover to dispense the wire in a tangle-free manner from the spool as it passes through the opening. The opening on the outer wall of the second cover portion may be an elongated capsule shape. Any other elongated shape known in the art may be used, such as a rectangle shape. Also, the opening may be on either portion of the wire spool cover without departing from the scope of the invention as claimed.

Further, preferably, the outer wall of the second cover portion may have a notch that can hold an end of a wire from the spool of wire when the spool of wire is not in use. Other means of holding an end of a wire known in the art may be used, such as a hole or a slit.

In an embodiment, the at least one side wall of the first cover portion and the at least one side wall of the second cover portion are each adapted to be attached to the shaft preferably by means of a slit that is contiguous with an aperture in the center of the side wall. The aperture is of a diameter to accommodate the diameter of the shaft. The slit is narrower than the diameter of the aperture where the slit connects with the aperture and gets wider in width, or tapers, as the slit approaches an outer edge of the side wall to allow the shaft to fit through the slit and force fit into the aperture to hold the spool cover in place on the shaft. However, the slit does not need to taper as described and can be of same width throughout its length.

The at least one side wall of the second cover portion preferably at least partially overlaps with the at least one side wall of the first cover portion when combined to form the spool cover. In such embodiment, the at least one side wall of the second cover portion further comprises at least one depression and the at least one side wall of the first cover portion further comprises at least one ridge. The at least one ridge of the at least one side wall of the first cover portion matingly fits into the at least one depression of the at least one side wall of the second cover portion when aligned and overlapped to keep the first cover portion and the second cover portion together as the spool cover. Any shape known in the art may be used for the at least one depression and any shape known in the art may be used for the at least one ridge as long as the ridge fits through the depression and holds the side wall of the first cover portion and the side wall of the second cover portion together in aligned and at least partially overlapped position. For example, in an embodiment, the at least one depression of the at least one side wall of the second cover portion may be two holes and the at least one ridge of the at least one side wall of the first cover portion may be two bolt heads (e.g., rounded bolt heads). Any number of depressions and ridges may be used.

Each of the at least one side wall of the first cover portion and each of the at least one side wall of the second cover portion preferably further comprises at least one handle. Each of the at least one handle of the at least one side wall of the first cover portion and the at least one side wall of the second cover portion may be comprised of an extended portion of the at least one side wall. Preferably, in an embodiment, each of the at least one handle comprises at least one finger hole.

In accordance with an embodiment of the disclosure, only one of the first cover portion and the second cover portion may be adapted to attach to the shaft.

In accordance with another aspect of the disclosure there is provided a wire spool cover adapted for covering at least a portion of a spool of wire, wherein the spool has opposing sides and a central hollow tube forming the spool, the spool adapted to be mounted on a shaft with the shaft passing through the central hollow tube, the inner diameter of the spool central hollow tube being larger than the diameter of the shaft, the wire spool cover adapted for preventing tangling of the wire during use of the spool of wire on the shaft.

The spool cover of this aspect of the disclosure comprises: a first cover portion adapted to partially encompass a portion of the spool of wire, the first cover portion comprising an outer wall and first and second side walls perpendicularly attached to the first cover portion's outer wall. The spool cover further comprises a second cover portion adapted to partially encompass another portion of the spool of wire, the second cover portion comprising an outer wall and first and second side walls attached to the second cover portion's outer wall, the first cover portion's side walls at least partially overlapping with the second cover portion's side walls when they are installed to cover the spool, the side walls engaging with each other to hold the first and second cover portions in position relative to each other when installed on the shaft to cover the spool. The first and second side walls of at least one of said cover portions are adapted to attach to the shaft adjacent opposing sides of the spool of wire without removing the spool of wire from the shaft, and the first and second side walls of at least one of said cover portions are each adapted with a slit that is contiguous with an aperture in the center of each of the side walls. The first and second side walls of one of said cover portions also has an aperture in the center of each of the side walls, and the apertures of the first and second side walls of each the first cover portion and the second cover portion are of a diameter to accommodate the diameter of the shaft to engage the shaft to at least partially cover the spool.

The spool cover in accordance with this aspect of the disclosure further comprises at least one collett portion adjacent and attached to each of the side walls of at least one cover portion, a first one of the at least one collett portion having an opening at least partially aligned with the aperture in the center of a side wall of the at least one cover portion. The at least one collett portion has a plurality of threaded through holes adapted for receiving and retaining a corresponding plurality of set screws adapted for tightening at varying locations relative to the shaft when the at least one cover portion is installed on the shaft, to help keep the spool and the first and second cover portions centered on the shaft as the spool spins on the shaft within the first and second spool cover portions to dispense wire without the wire becoming tangled.

In an embodiment, the at least one collett portion of the wire spool cover of this aspect of the disclosure may comprise a plurality of corresponding collett portions adjacent each side wall of the second cover portion, each collett portion of each plurality of corresponding collett portions having an intermediate contact surface adapted to engage with at least one intermediate contact surface of another collett portion of the corresponding collett portions. Further, each such collett portion of each plurality of corresponding collett portions may define a plurality of threaded through holes, each threaded through hole being optionally adapted for being aligned with a threaded through hole of another collett portion of the corresponding collett portions and adapted for receiving a set screw through aligned threaded through holes of corresponding collett portions.

The set screws are for tightening each of the corresponding collett portions onto the shaft, each collett portion of each of the plurality of corresponding collett portions defining an opening adapted to partially encircle the shaft when the corresponding collett portions are installed on the shaft, wherein one collett portion of each of the corresponding collett portions is attached to a side wall of one of said first and second cover portions with the opening of the attached one collett portion being at least partially aligned with the aperture in the center of the side wall to which the one collett portion is attached.

Accordingly, another of the corresponding collett portions is adapted to be attached via the set screws to the first collet portion with at least one of each of the collett portions' mating intermediate surfaces being in contact and with at least one threaded through hole of each of the collett portions thus in contact being aligned so that the openings of the collett portions thus in contact at least partially enclose around the shaft. Thus, the plurality of corresponding collett portions combined are adapted for maintaining the spool centered on the shaft and relative to the first and second spool cover portions as the spool spins on the shaft within the first and second spool cover portions to dispense wire without the wire becoming tangled.

Preferably, in this aspect of the disclosure, in an embodiment the wire spool cover has a plurality of corresponding collett portions, each of which comprises a pair of first and second collett portions, each the first collett portion being attached to a corresponding different side wall of one of said first and second cover portions, each of the first and second collett portions defining threaded through holes and having intermediate surfaces adapted to engage when the first and second cover portions are covering a spool and when the first and second collett portions are installed on the shaft. Thus, when installed, the through holes of each the first and second collett portions are aligned and therefore adapted to receive a corresponding plurality of set screws passing through the aligned through holes to secure each the first and second collett portions together in mating pairs to secure the pair of first and second collett portions to the shaft. In this way, each of the first and second corresponding collett portions are combined being adapted for maintaining the spool centered on the shaft and relative to the first and second spool cover portions as the spool spins on the shaft within the first and second spool cover portions to dispense wire without the wire becoming tangled.

In an embodiment of the wire spool cover in accordance with this aspect of the disclosure, one of the first cover portion and the second cover portion further comprises an opening on the outer wall of one of the cover portions adapted for allowing the wire on the spool to pass through the outer wall, allowing the spool of wire to rotate freely on the shaft while encompassed by the spool cover to dispense the wire in a tangle-free manner from the spool as it passes through the opening. This opening may, in an embodiment, be defined in the outer wall of the second cover portion, and it preferably comprises an elongated capsule shape opening.

In accordance with another aspect of the disclosure, there is provided a wire spool cover adapted for covering at least a portion of a spool of wire, wherein the spool has sides and a central hollow tube forming the spool between the sides, the spool adapted to be mounted on a shaft with the shaft passing through the central hollow tube, the wire spool cover adapted for preventing tangling of the wire during use of the spool of wire on the shaft.

An embodiment of the wire spool cover in accordance with this aspect of the disclosure comprises a first cover portion adapted to partially encompass a portion of the spool of wire, the first cover portion comprising an outer wall and first and second side walls perpendicularly attached to the first cover portion's outer wall. Such a wire spool cover further comprises a second cover portion adapted to partially encompass another portion of the spool of wire, the second cover portion comprising an outer wall and first and second side walls attached to the second cover portion's outer wall, the first cover portion's side walls at least partially overlapping with the second cover portion's first and second side walls when the first and second cover portions are installed to at least partially cover the spool on the shaft, wherein the side walls engage with each other to aid in holding the first and second cover portions in position relative to each other to cover the spool when the first and second cover portions are installed on the shaft.

The cover portions of this aspect and embodiment of the disclosure are provided wherein the first and second side walls of one of said first and second cover portions are each adapted with a slit that is contiguous with an aperture in the center of each of the first and second side walls of the cover portion, and wherein the first and second sidewalls of another of the first and second cover portions are adapted with an aperture of a diameter to accommodate the diameter of the shaft. Thus, the first and second side walls of at least one of first and second cover portions are each adapted to be installed to engage the shaft adjacent opposing sides of the spool of wire without removing the spool of wire from the shaft to at least partially cover the spool and to allow dispensing of wire without the wire becoming tangled.

The wire spool cover of this aspect of the disclosure further comprises a plurality of attachment member portions adapted to releasably interconnect the first and second cover portions around a spool of wire. Therefore, there is at least one attachment member portion attached to the first cover portion and at least one other attachment member portion attached to the second cover portion, each of the plurality of attachment member portions adapted to be releasably attached with a corresponding one other of the plurality of attachment member portions to help hold the first and second cover portions in position covering the wire spool on the shaft.

The wire spool cover of this aspect of the disclosure further preferably comprises a plurality of reinforcing collett portions, the reinforcing collett portions preferably being made of plastic or rubber and being adapted for being attached to and shaped to be substantially coextensive with the apertures of the first and second side walls of the first cover portion to reinforce installation of the first cover portion on the shaft and also adapted to reinforce installation of the second cover portion relative to the shaft when the first cover portion and the second cover portion are releasably attached to each other with the plurality of attachment member portions and are installed around the shaft to cover the spool.

The plurality of attachment member portions of this embodiment of a spool cover preferably comprise a plurality of strips of paired hook and loop attachment member material with at least one strip attached to the first cover portion and at least one other strip attached to the second cover portion, the attachment portions being adapted for releasably interconnecting the first and second cover portions to each other when installed to at least partially cover a wire spool on a shaft. As with other embodiments of the disclosure, the wire spool cover of this aspect and embodiment of the disclosure, preferably further comprises a preferably elongated capsule shaped opening on the outer wall adapted for allowing the wire on the spool to pass through the outer wall of the second cover portion, allowing the spool of wire to rotate freely on the shaft while encompassed by the spool cover to dispense the wire in a tangle-free manner from the spool as it passes through the opening.

Preferably, the first and second cover portions of this aspect and embodiment of the disclosure are more readily disposable and recyclable being constructed of cardboard or other more friendly-to-the-environment disposable material. These disposable cardboard cover portions may further comprise a plurality of durable reinforcements installed on an inside surface of the outer walls of each of the first and second cover portions to reinforce the cardboard material against tearing or other wear damage from engaging with the spool during operation.

In accordance with another aspect of the disclosure, there is provided a wire spool cover adapted for covering at least a portion of a spool of wire, wherein the spool has sides and a central hollow tube forming the spool, the spool adapted to be mounted on a shaft with the shaft passing through the central hollow tube, the inner diameter of the spool central hollow tube being larger than the diameter of the shaft, the wire spool cover adapted for preventing tangling of the wire during use of the spool of wire on the shaft.

The wire spool cover in accordance with this aspect of the disclosure comprises: a first outer wall having opposing side edges and opposing front and back edges, and a second outer wall having opposing side edges and opposing front and back edges. Further, in accordance with this aspect of the disclosure, there are provided a plurality of removable edge connectors, each edge connector defining a plurality of screw holes spaced around a periphery of each edge connector, and each edge connector being attached as by gluing, riveting, or screws, to a side edge of the corresponding first and second outer walls.

The wire spool cover in accordance with this aspect of the disclosure further comprises: a plurality of side wall members, each side wall member defining a plurality of screw holes and adapted to be aligned with the screw holes of corresponding ones of the plurality of removable edge connectors. In this embodiment, the side wall members are adapted for removable installation on and perpendicular to the side edges of corresponding ones of the first and second outer walls when interconnected with the first and second outer walls to form first and second cover portions.

In this aspect and embodiment, similar to some other aspects and embodiments described herein, the first cover portion's first and second side walls are adapted to be at least partially overlapping with the second cover portion's first and second side walls when the first and second cover portions are installed to cover the spool. While being so overlapped, the side walls engage with each other to hold the first and second cover portions in position relative to each other when installed on the shaft to cover the spool.

In this aspect and embodiment of the disclosure, the first and second side walls of at least one of the first and second cover portions are adapted to attach to the shaft adjacent opposing sides of the spool of wire and without removing the spool of wire from the shaft. To help accomplish this, the first and second side walls of at least one of the first and second cover portions are each adapted with a slit that is contiguous with an aperture in the center of each of the first and second side walls of the cover portion. Further, the first and second side walls of another of the first and second cover portions also defines a central aperture, and the apertures of the first and second side walls of corresponding first and second cover portions are each of a diameter to accommodate the diameter of the shaft. Accordingly, the first and second side walls of at least one of the first cover portion and the second cover portion are installable on the shaft to at least partially cover the spool, the first and second outer walls being screwed to corresponding ones of the first and second side wall members.

In accordance with this aspect and embodiment of the disclosure, at least one of the side wall members (but preferably both side wall members) is removable from at least one of the corresponding first and second outer walls to facilitate refurbishing of side walls and or outer walls after they become worn during use to prevent tangling of wire as it is being dispensed through the spool.

As with some previous embodiments, the wire spool cover of this aspect and embodiment provides that the side walls of the second cover portion at least partially overlap with the side walls of the first cover portion when combined to form the spool cover. Further, at least one of the side walls of one of the first and second cover portions further comprises at least one depression and at least one of the side walls of another of the first and second cover portions further comprises at least one ridge, wherein the at least one ridge of the first cover portion matingly fit into the at least one depression, or hole, when the side walls are aligned and overlapped to keep the first cover portion and the second cover portion aligned and together while covering the spool.

In an embodiment, the at least one depression, or hole, comprises a plurality of depressions, or holes, and the at least one ridge comprises a plurality of bolt heads. Further, it will be appreciated that the foregoing described at least one ridge may be on either cover portion, and the foregoing described at least one depression, or hole, may be on an opposing cover portion without departing from the spirit of a wire spool cover claimed herein.

In accordance with an aspect and embodiment of the disclosure, at least one of the first and second side walls of one of the first and second cover portions further comprises particularly shaped protrusions, and one of the first and second side walls of another of the first and second cover portions comprises particularly shaped mating portions, wherein the particularly shaped mating portions and the particularly shaped protrusions are complementarily shaped. Thus, the particularly shaped protrusions matingly fit into the complementarily shaped mating portions when the first cover portion and the second cover portion are aligned such that the first cover portion and the second cover portion are combined to form the spool cover. As with some previous embodiments, the wire spool cover of this aspect and embodiment provides that at least one side wall of the first and second side walls of one of the first and second cover portions, and wherein at least one side wall of the first and second side walls of another of the first and second cover portions, further comprises a handle. The handle may comprise a rounded tab with a circular hole defined therein enabling pulling on the rounded tab with one's finger to enable removal of the cover portion(s) from covering the wire spool, a squared off tab with a circular hole defined therein enabling pulling on the squared off tab with one's finger to enable removal of the cover portion(s) from covering the wire spool, an opening large enough to insert multiple or all of a user's fingers on a hand therein for enabling removal of the cover portion(s), or a rounded or squared off knob enabling gripping by the user's hands to enable removal of the cover portion(s).

It will be appreciated that the novel features of the foregoing aspects and embodiments address problems in the prior art, such as the tangling of wire as it is pulled from the spool, often when the installer is at some distance from the spool, requiring a pause in the installation process to return and untangle the wire. The process of mounting the wire spool cover is easy to implement and effective. The resulting cover allows the installer to focus on the work of installation, and this in turn provides for a faster and more efficient installation.

It will also be appreciated by those skilled in the art that there are various possible combinations of the above-described elements and sub-elements for various embodiments of the invention, whether such elements and sub-elements be combined in whole or in part, which may be employed without departing from the scope and spirit of the invention as claimed.

The subject matter of the present disclosure is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DETAILED DESCRIPTION

Figure 1:
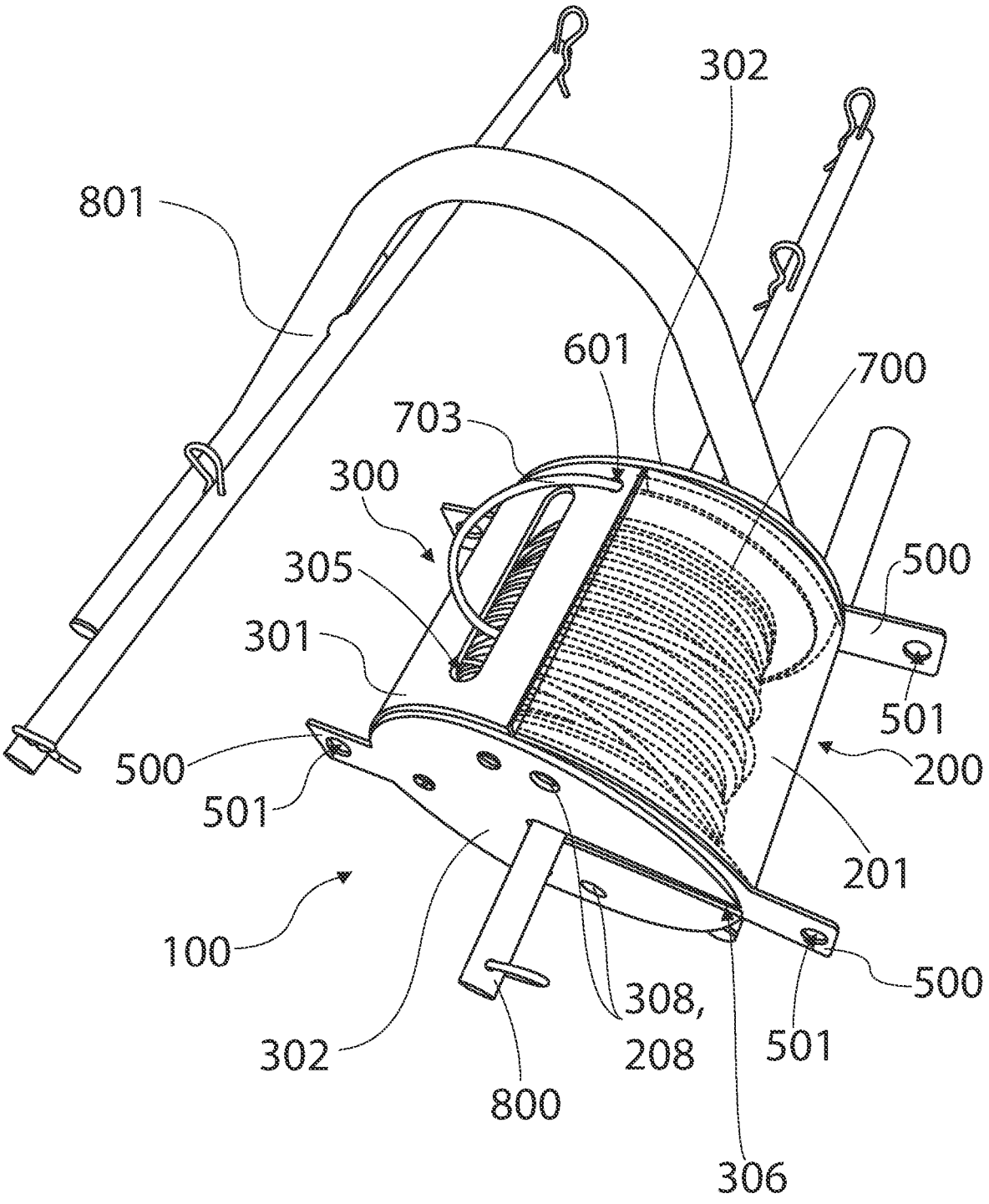
FIG. 1 is a top left perspective view of an embodiment of a spool cover on a shaft, with a first cover portion and a second cover portion, the first cover portion being see-through and with a spool of wire showing in dotted lines under the first cover portion.

Referring to FIGS. 1-10, and in accordance with one or more aspects of the disclosure, there are provided embodiments of a wire spool cover. For a first embodiment there is shown specifically in FIGS. 1-9 a wire spool cover 100 having two generally mating half cylindrical portions, a first cover portion 200 and a second cover portion 300, adapted for covering a wire spool 700 in order to prevent the wire 703 from getting tangled as it is rapidly pulled off the wire spool. The wire spool cover 100 is generally cylindrical in shape when the two half-cylindrical outer walls 201, 301 of the first and second cover portions 200, 300 are combined as the wire spool cover 100 is placed around a spool of wire 700, cord or other elongated material. Other shapes besides cylinder can be used for the wire spool cover 100 as long as it can encase the spool of wire 700 and allow the spool of wire 700 to spin freely within the exterior of the wire spool cover 100 as the wire 703 is pulled off the wire spool 700. The wire spool cover 100 is of a diameter large enough to encompass the wire spool 700 and fits relatively snugly enough to allow spinning of the wire spool 700. The wire spool cover 100 is preferably made of plastic, such as polyethylene terephthalate glycol (PETG), but other hard and durable materials known in the art may be used, such as wood or metal. The wire spool cover 100 may be see-through (as partially shown in FIG. 1) but does not need to be. Preferably, both the outer wall 201 of the first cover portion 200 and the outer wall 301 of the second cover portion 300 may be see-through as it may be desirable to allow viewing into the cover during use.

The wire spool cover 100 is adapted to cover wire 703 comprised of speaker wire, electrical wire, cable television type medium, etc., for between 22-gauge wire and up to 8-gauge wire, wherein the wire spools may hold between 500 feet and 2500 feet of wire. However, wire spool cover size can be adjusted for smaller or larger gauge wires and to accommodate different lengths of wires.

FIG. 1 is a top left perspective view of the spool cover 100 on the shaft 800 of a wire spool caddy 801, with the first cover portion 200 and the second cover portion 300. The first cover portion 200 in depicted as being see-through with the spool of wire 700 showing in dotted lines under the first cover portion 200. As seen in FIG. 1, as a method of use, a wire spool 700 may be mounted on a metal shaft 800 that allows the wire spool 700 to rotate freely, such shaft 800 may be part of a single- or multiple-shaft wire spool caddy 801. The wire spool 700 generally has opposing sides (flanges) and a central hollow tube (a barrel with an arbor hole) forming the spool. The spool is adapted to be mounted on a shaft 800 with the shaft passing through the central hollow tube. The wire spool cover 100 is designed to encompass the wire spool 700 without hindering its rotation around the shaft 800 and adapted for preventing tangling of the wire 703 during use of the spool of wire 700 on the shaft 800. The wire spool cover 100 is comprised of the first cover portion 200 and the second cover portion 300, both adapted to partially encompass a portion of the spool of wire 700. The first cover portion 200 is comprised of an outer wall 201 and at least one side wall 202 (shown in FIGS. 2-9). The second cover portion 300 is comprised of the outer wall 301 and the at least one side wall 302.

FIG. 1 shows the first cover portion 200 and the second cover portion 300 are positionable to each partially encompass the spool of wire 700 so at least one edge 203 (shown in FIGS. 3-5) of the outer wall 201 of the first cover portion 200 and at least one edge 303 (shown in FIGS. 3, 7, 8) of the outer wall 301 of the second cover portion 300 align. The embodiment shown in FIGS. 1-9 have two edges 203 on the opposite side of the outer wall 201 of the first cover portion 200 that align with the two edges 303 on the opposite side of the outer wall 301 of the second cover portion 300. The edges 203, 303 are shown as preferably flat and straight so edges 203, 303 align parallel to each other. Other shapes that allow combining of the edges 203 of the first cover portion 200 with the edges 303 of the second cover portion 300 may be used. How the first cover portion 200 and the second cover portion 300 combine and hold together will be discussed in detail later.

The second cover portion 300 preferably has an opening 305 in the outer wall 301. The opening 305 allows free pulling/feeding of wire 703 through the opening 305. The opening 305 is adapted for allowing the wire 703 on the spool 700 to pass through the outer wall 301 of the second cover portion 300, which allows the spool of wire 700 to rotate freely on the shaft 800 while encompassed by the spool cover 100 to dispense the wire 703 in a tangle-free manner from the spool 700 as the wire 703 is pulled and passed through the opening 305. The opening 305 is elongated capsule shaped for this embodiment, but other elongated shapes known in the art, such as a rectangle, may be used. The edges of the opening 305 functions to create a surface on which the wire 703 drags against as it is pulled through the opening 305, causing friction that slows down the speed of wire 703 as the wire is dispensed from the spool 700, thereby preventing the tangling of the wire as it is pulled out. The opening 305 is preferably about 0.5 inches away from one of the edges 303 (shown in FIGS. 3 and 8) of the outer wall 301 of the second cover portion 300 that aligns with one of the edges 203 (shown in FIGS. 3-5) of the outer wall 201 of the first cover portion 200. However, the opening 305 may be placed in different distance from the one of the edges 303 (shown in FIGS. 3, 7, 8) of the outer wall 301 of the second cover portion 300. The opening 305 may also be placed on the outer wall 201 of the first cover portion 200 instead without changing its function.

The outer wall 301 of the second cover portion 300 preferably also has a notch 601, shown as a hole 601 with an end of the wire 703 inserted in FIG. 1. The notch 601 holds an end of a wire 703 from the spool of wire 700 when the spool of wire 700 is not in use, to prevent tangling of the wire 700 end and facilitate organized storage of the spool of wire 700. Even when the spool of wire 700 is not mounted on the shaft 800, the spool cover 100 can be placed around the spool of wire 700 and the end of the wire 703 can be pulled through the opening 305 and into the notch 601 for easy storage. The opening of the notch 601 may be of a diameter big enough to hold a wire end for between 22-gauge wire and up to 8-gauge wire. Typically, this would be a diameter big enough to handle between 0.0641 inches and up to 0.1285 inches.

In this embodiment, the at least one side wall 202 of the first cover portion 200 is two side walls 202 and, the at least one side wall 302 of the second cover portion 300 is two side walls 302. The side walls 202 of the first cover portion 200 and the side walls 302 of the second cover portion 300 are each adapted to attach to the shaft 800 adjacent an opposing side of the spool of wire 700 without removing the spool of wire 700 from the shaft 800.

In FIG. 1, the side walls 202 (not shown in FIG. 1) of the first cover portion 200 are two at least semi-circular shaped side walls perpendicularly attached to the opposing sides of the outer wall 201 of the first cover portion 200. The side walls 302 of the second cover portion 300 are two at least semi-circular shaped side walls perpendicularly attached to the opposing sides of the outer wall 301 of the second cover portion 300. As seen in FIG. 1, each of the side walls 202, 302 attach to the shaft 800 by means of a slit 206, 306 (206 not shown in FIG. 1). The slits 206, 306 will be discussed in detail later.

In an embodiment, the at least one side wall 302 of the second cover portion 300 preferably at least partially overlaps with the at least one side wall 202 of the first cover portion 200 when combined to form the spool cover 100. In the embodiments shown in FIGS. 1-9, the two side walls 302 of the second cover portion 300 overlaps the two side walls 202 of the first cover portion 200 when combined to form the wire spool cover 100. The spool cover 100 can be designed so the side walls 202 of the first cover portion 200 overlap the side walls 302 of the second cover portion 300 instead. The at least one side wall 302 of the second cover portion 300 preferably have at least one depression 308 and the at least one side wall 202 of the first cover portion 200 preferably have at least one ridge 208. The overlapped side walls 202, 302 can be assisted in being combined by inserting the at least one ridge 208 into the at least one depression 308. As can be seen in FIGS. 1-9, the at least one depression 308 may be two holes 308 and the at least one ridge 208 may be two bolt heads or two screw heads 208 that matingly fit partially within the two holes 308 when the first cover portion 200 and the second cover portion 300 are aligned and overlapped.

The at least one side wall 202 of the first cover portion 200 and the at least one side wall 302 of the second cover portion 300 may preferably have at least one handle 500. The at least one handle 500 is preferably comprised of an extended portion of the at least one side wall 202, 302. However, other means of attaching or having a handle known in the art may be used. The at least one handle 500 may preferably have at least one finger hole 501. As shown in FIGS. 1-9, the at least one handle 500 may be one handle 500 with one finger hole 501 made of extended portion of the side wall 202, 302.

Figure 2:
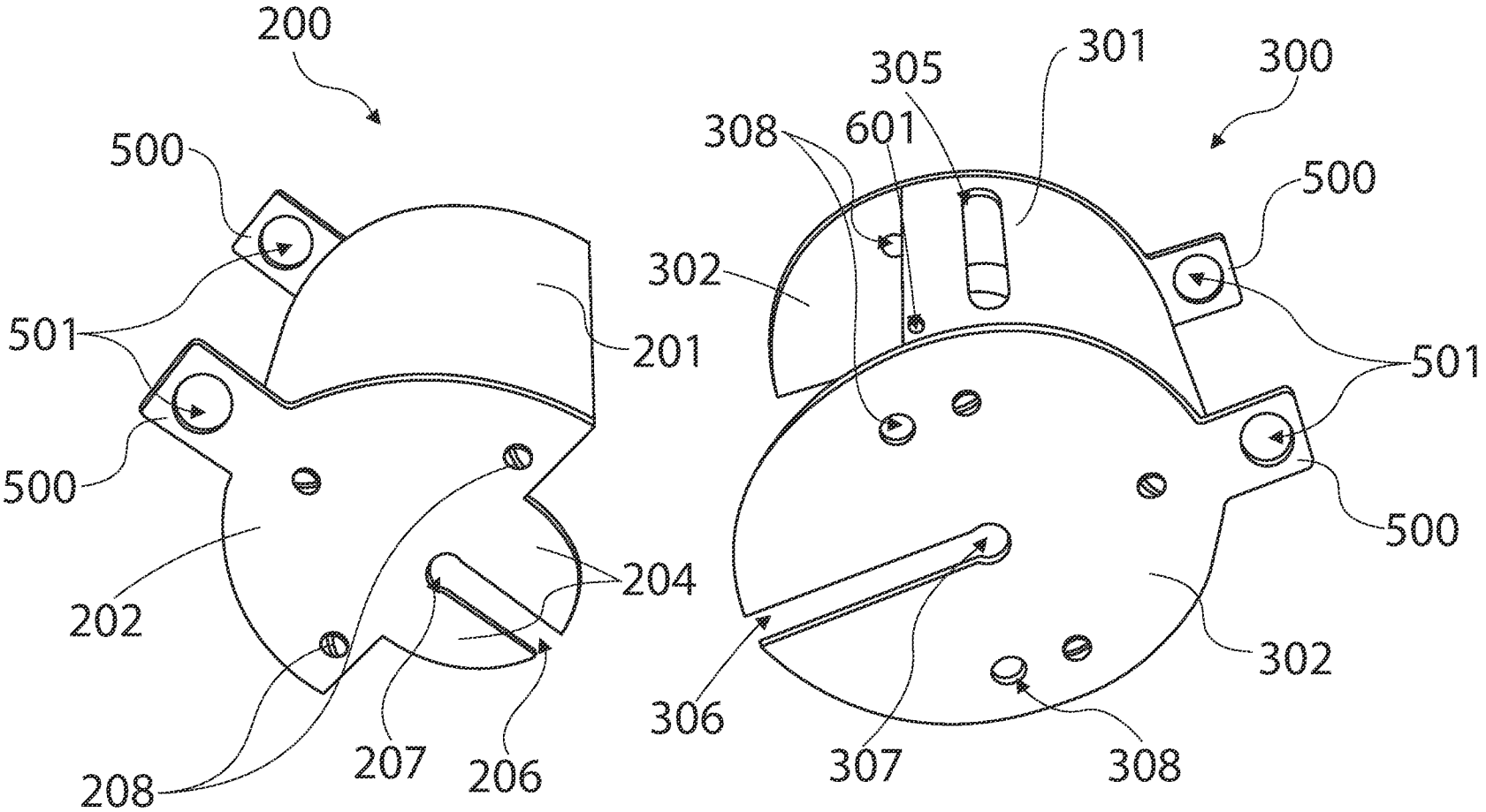
FIG. 2 is a side perspective view of the first cover portion and the second cover portion of the spool cover next to each other.
Figure 4:
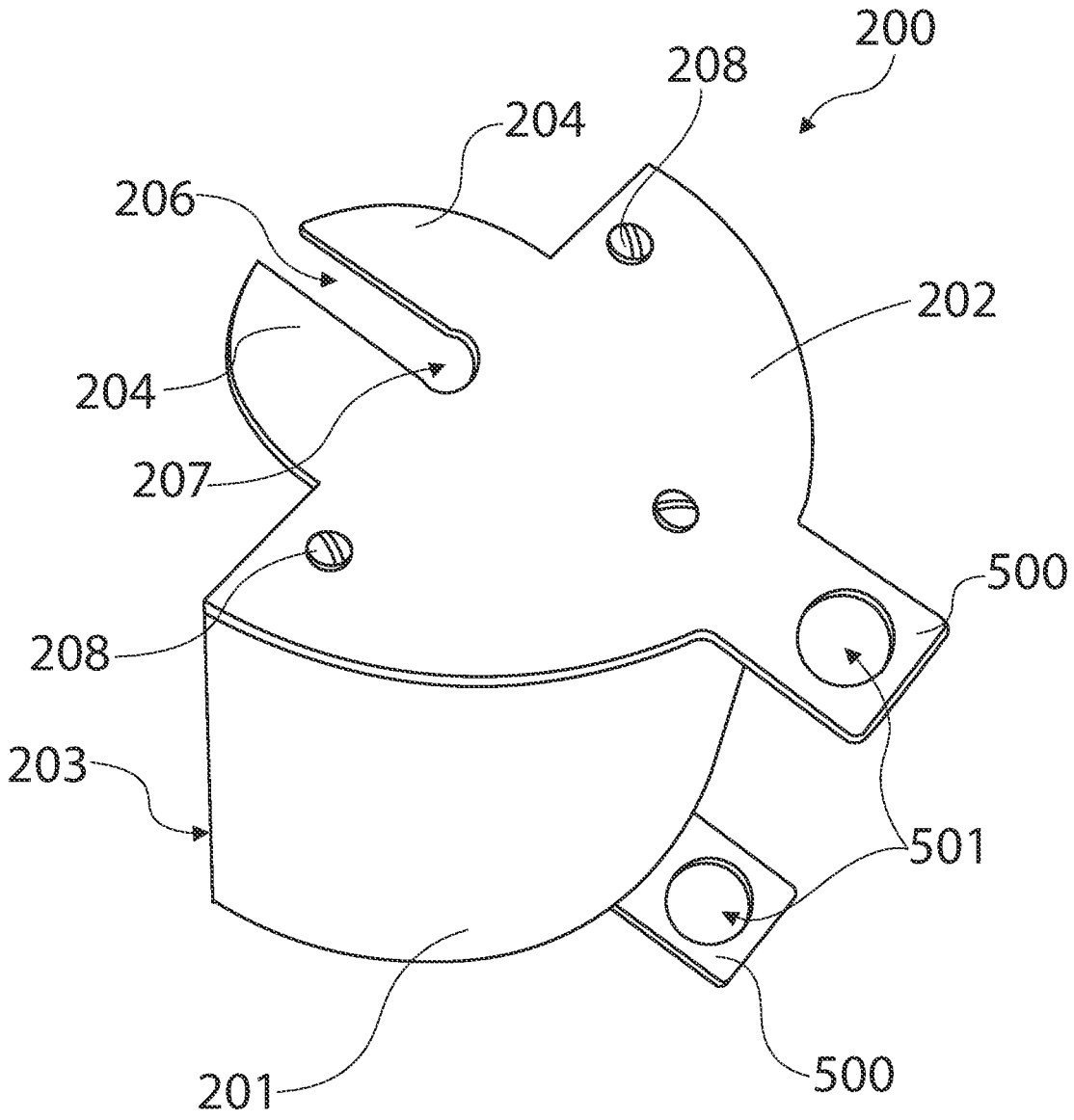
FIG. 4 is a close-up external perspective view of the first cover portion from FIG. 2.
Figure 7:
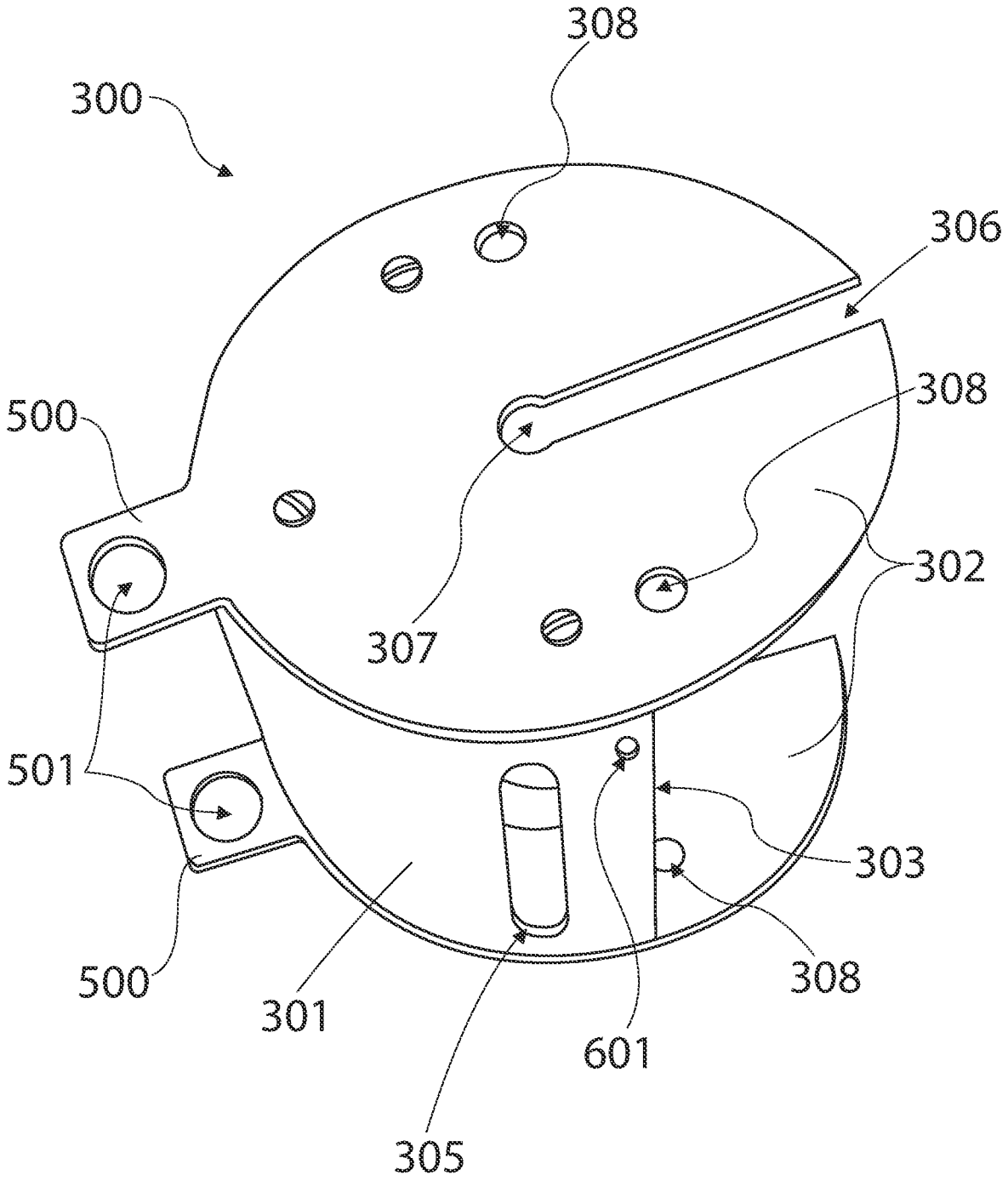
FIG. 7 is a close-up external perspective side view of the second cover portion from FIG. 2.

FIG. 2 is a side perspective view of the first cover portion 200 and the second cover portion 300 of the spool cover 100 next to each other. FIG. 4 is a close-up external perspective view of the first cover portion 200 from FIG. 2. FIG. 7 is a close-up external perspective side view of the second cover portion 300 from FIG. 2. The second cover portion 300 has the curved outer wall 301 that is half cylindrical, the opening 305, and the notch 601. Two side walls 302 of the second cover portion 300 are each perpendicularly attached to the outer wall 301 by three screws. These screws allow for replacement of the side walls and for accommodating different size spools with different sized side walls. The two side walls 302 each have an extended portion forming a handle 500 with a finger hole 501. The two side walls 302 each further has two holes 308 for depression 308. Each side wall 302 of the second cover portion 300 has the slit 306 and an aperture 307, which allows the side wall 302 to attach onto the shaft 800 (shown in FIG. 1) without removing the spool of wire 700 (shown in FIG. 1). The slit 306 is contiguous with the aperture 307. The aperture 307 is in the center of the shape of the side wall 302 and is of a diameter to accommodate the diameter of shaft 800. The slit 306 is narrower than the diameter of the aperture 307 where the slit 306 connects with the aperture 307 and gets wider in width, or tapers, as the slit 306 approaches an outer edge of the side wall 302. The narrower diameter of the slit 306 where the slit 306 connects with the aperture 307 allows the shaft 800 to force fit into the aperture 307 to hold the spool cover 100 in place on the shaft 800 while the wider portions of the slit 306 allows the shaft 800 to fit through the slit 306 easily.

The first cover portion 200 has a curved outer wall 201 that is half cylindrical. Two side walls 202 are each attached perpendicularly to the curved outer wall 201 by three screws. Two of the screws 208 are used as the ridges 208 to connect with the holes 308 of the side walls 302 of the second cover portion 300 when aligned and overlapped, as seen in FIG. 1, to assist in holding the combined first cover portion 200 and the second cover portion 300 together into the wire spool cover 100. The two side walls 202 of the first cover portion 200 each have an extended portion forming a handle 500 with a finger hole 501. Each side wall 202 of the first cover portion 200 has the slit 206 and an aperture 207, which allows the side wall 202 to attach onto the shaft 800 (shown in FIG. 1) without removing the spool of wire 700 (shown in FIG. 1). The slit 206 is contiguous with the aperture 207. The aperture 207 is in the center of the shape of the side wall 202 and is of a diameter to accommodate the diameter of shaft 800. The slit 206 is narrower than the diameter of the aperture 207 where the slit 206 connects with the aperture 207 and gets wider in width, or tapers, as the slit 206 approaches an outer edge of the side wall 202. The narrower diameter of the slit 206 where the slit 206 connects with the aperture 207 allows the shaft 800 to force fit into the aperture 207 to hold the spool cover 100 in place on the shaft 800 while the wider portions of the slit 206 allows the shaft 800 to fit through the slit 206 easily. While the slits 206, 306 preferably have tapering shape in this embodiment, the slits 206, 306 do not need to taper and can be of same width throughout and other means of holding the shaft 800 in the aperture 207, 307 known in the art may be used. FIG. 2 also shows the particularly shaped mating portion 204 of the side wall 202 of the first cover portion 200, which will be described in detail below.

Figure 3:
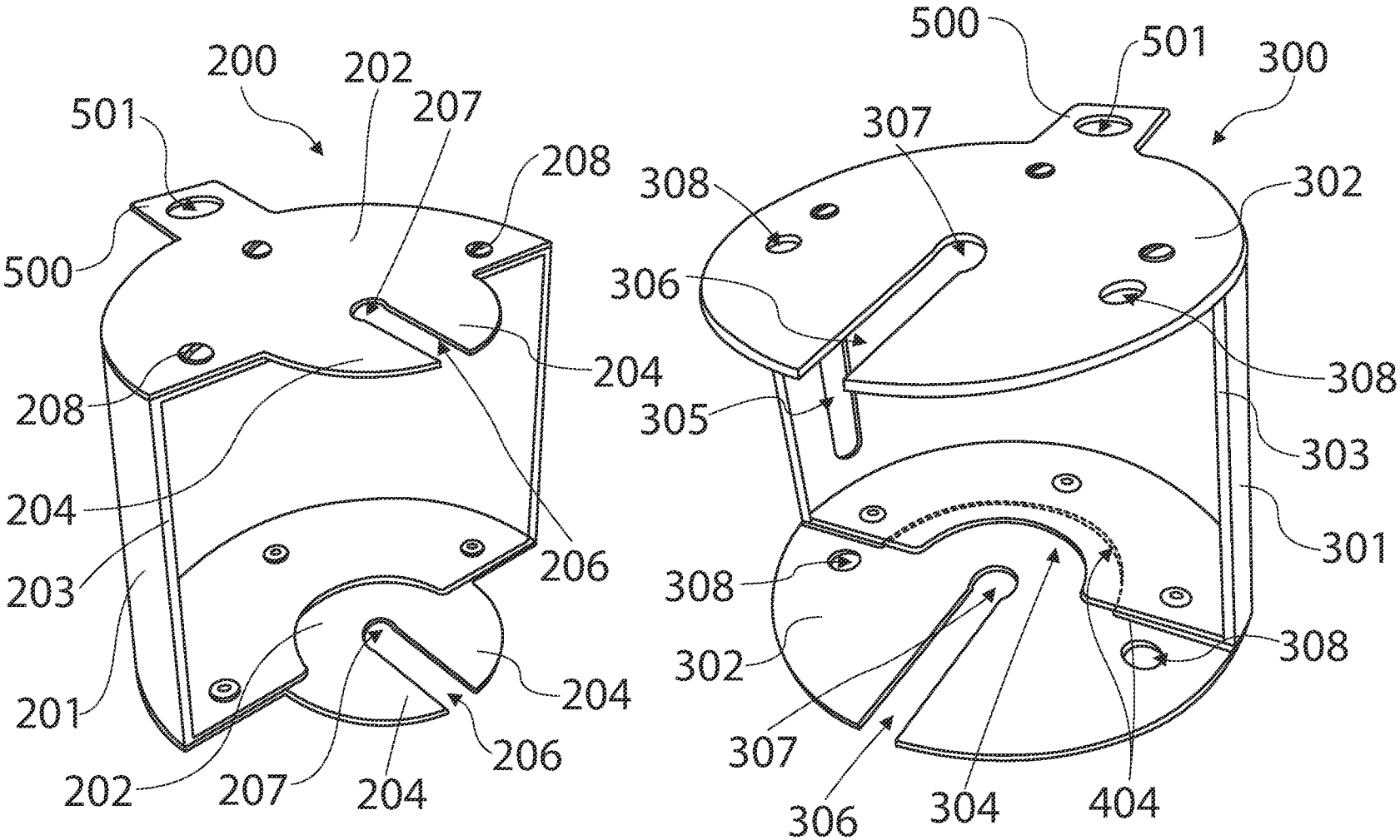
FIG. 3 is bottom perspective views of the first cover portion and the second cover portion of the spool cover, wherein a complementarily shaped layer of material of a complementarily shaped indentation in each of the side walls of the second cover portion, adapted for receiving particularly shaped protrusions of each of the side walls of the first cover portion, is shown with dashed lines.
Figure 5:
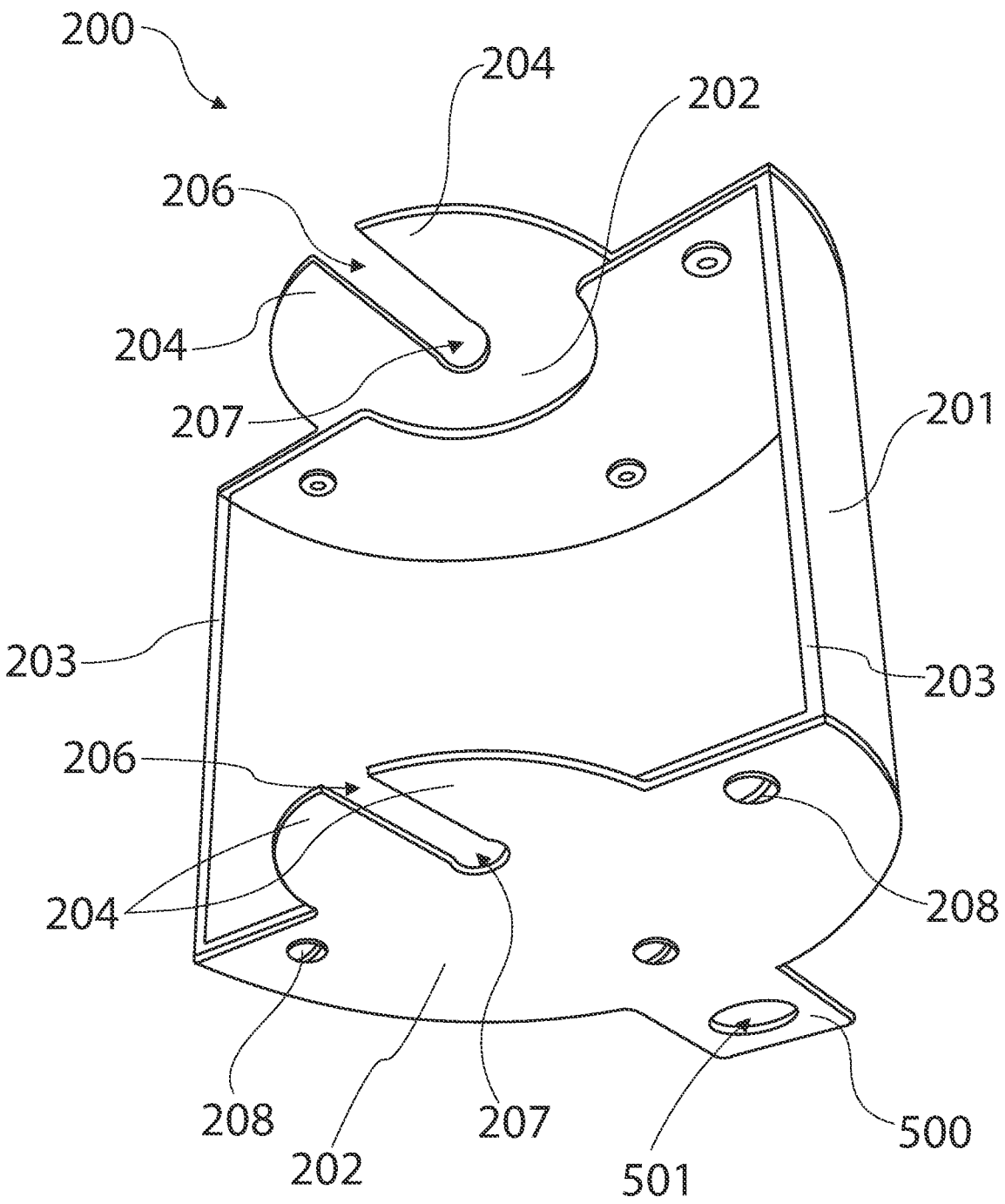
FIG. 5 is a close-up internal perspective view of the first cover portion from FIG. 3.
Figure 8:
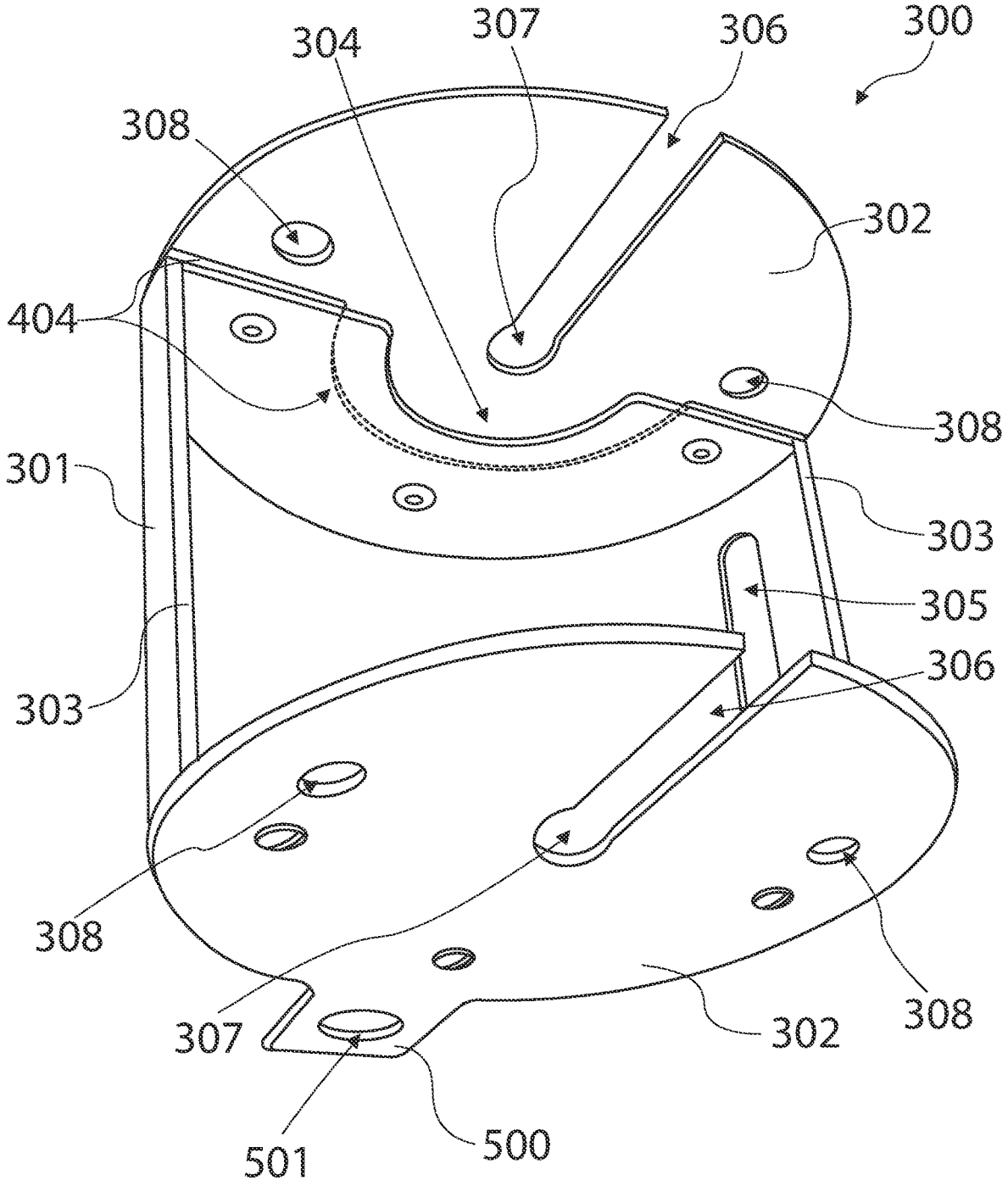
FIG. 8 is a close up internal perspective side view of the second cover portion from FIG. 3.

FIG. 3 is bottom perspective views of the first cover portion 200 and the second cover portion 300 of the spool cover 100. FIG. 5 is a close-up internal perspective view of the first cover portion 200 from FIG. 3. FIG. 8 is a close up internal perspective side view of the second cover portion 300 from FIG. 3. Dashed line is used to show an edge of a complementarily shaped layer of material 404 of the complementarily shaped indentation 304, optionally sandwiched between a portion of the outer wall 301 and a portion of the side wall 302 of the second cover portion 300. In an embodiment and in accordance with an aspect of the disclosure, the at least one side wall 202 of the first cover portion 200 may preferably comprise a particularly shaped mating portion 204 that matingly fit with a complementarily shaped mating portion 304 on the at least one side wall 302 of the second cover portion 300. The first cover portion 200 and the second cover portion 300 are held together by mating of the particularly shaped mating portion 204 and the complementarily shaped mating portion 304 when aligned and combined to form the wire spool cover 100.

The particularly shaped mating portion 204 of the at least one side wall 202 of the first cover portion 200 may preferably be at least one particularly shaped protrusion 204. The complementarily shaped mating portion 304 of the at least one side wall 302 of the second cover portion 300 may preferably be at least one complementarily shaped indentation 304. The at least one particularly shaped protrusion 204 matingly fits into the at least one complementarily shaped indentation 304 when the first cover portion 200 and the second cover portion 300 are aligned such that the first cover portion 200 and the second cover portion 300 combine to form the spool cover 100.

The at least one complementarily shaped indentation 304 may be formed by the complementarily shaped layer of material 404 attached between the portion of the outer wall 301 of the second cover portion 300 and the portion of the side wall 302 of the second cover portion 300 such that the at least one particularly shaped protrusion 204 of the at least one side wall 202 of the first cover portion 200 fits between the portion of the outer wall 301 of the second cover portion 300 and the portion of the side wall 302 of the second cover portion 300. An edge of the at least one particularly shaped protrusion 204 of the at least one side wall 202 of the first cover portion 200 matingly aligns with the edge of the complementarily shaped layer of material when the at least one particularly shaped protrusion 204 of the side wall 202 of the first cover portion 200 is pushed into the at least one complementarily shaped indentation 304 of the at least one side wall 302 of the second cover portion 300. Thus, the first cover portion 200 and the second cover portion 300 combine to form the wire spool cover 100. Other means of holding the first cover portion 200 and the second cover portion 300 together may be used.

FIGS. 2-6 depict two particularly shaped protrusions 204, each half-semi-circle shaped, together forming a semi-circle shape with the slit 206 separating the two particularly shaped protrusions 204. When the first cover portion 200 and the second cover portion 300 are aligned and combined, the two particularly shaped protrusions 204 slide and matingly fit into the semi-circle shaped complementarily shaped indentation 304, shown in FIGS. 3 and 8, formed by the edge of the complementarily shaped layer of material 404 between the portion of the outer wall 301 of the second cover portion 300 and the portion of the side wall 302 of the second cover portion 300. The dashed line outlines the edge of the complementarily shaped layer of material 404.

Figure 6:
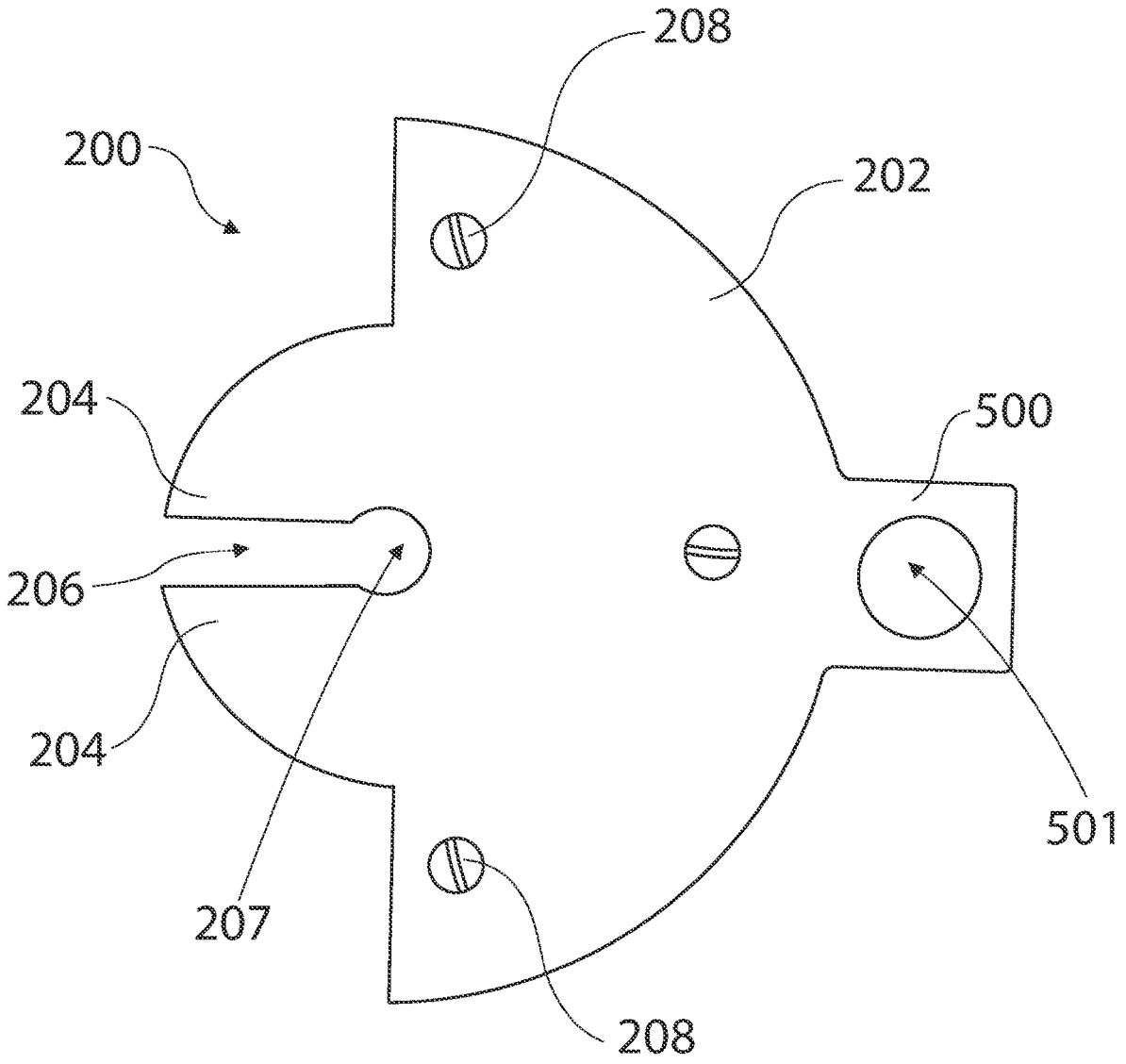
FIG. 6 is a side view of the first cover portion showing the side wall.

FIG. 6 is a side view of the first cover portion 200 showing one of the two side walls 202. The side wall 202 has a shape of a larger semi-circle with a square handle 500 with the finger hole 501 attached to its outer edge. The larger semi-circle portion of the side wall 202 is connected to a smaller semi-circle portion formed by the two particularly shaped protrusions 204, which are each half-semi-circle in shape. The slit 206 separates the two particularly shaped protrusions 204 from each other. The slit 206 is of width to allow shaft 800 (shown in FIG. 1) to slide through and into the aperture 207. The width of slit 206 is smaller than the diameter of the aperture 207 to allow for forced fitting of the shaft 800, which prevents rotation of the wire spool cover 100. The slit 206 may be tapered so it is larger in width towards the edge of the smaller semi-circle but does not need to be. The aperture 207 is placed in the center of the side wall 202, where the smaller semi-circle portion and the larger semi-circle portion merge. The aperture 207 is designed to line up with the spindle of the spool of wire 700 (shown in FIG. 1). Usually for 8 to 14-gauge wires, the spindle of the spool 700 is between 1 inch to 1.125 inches in diameter. The diameter of the shaft 800 is usually between 0.25 inches to 0.75 inches, and the aperture 207 size should be between 0.25 inches to 0.75 inches to accommodate the diameter of the shaft 800. The side wall 202 is attached to the outer wall 201 (not shown in FIG. 6) by three screws. Screws are preferred as they allow for easy removal and attachment of side wall 202, which allows for switching out side walls 202 with different aperture 207 sizes to accommodate for differing shaft 800 sizes. Two of the screws 208 also act as the ridges 208 that combine with the depression or the hole 308 (not shown in FIG. 6) of the side wall 302 of the second cover portion 300. More than three screws may be used, and other means of attachment known in the art may be used. Other means and shapes of ridges may also be used.

Figure 9:
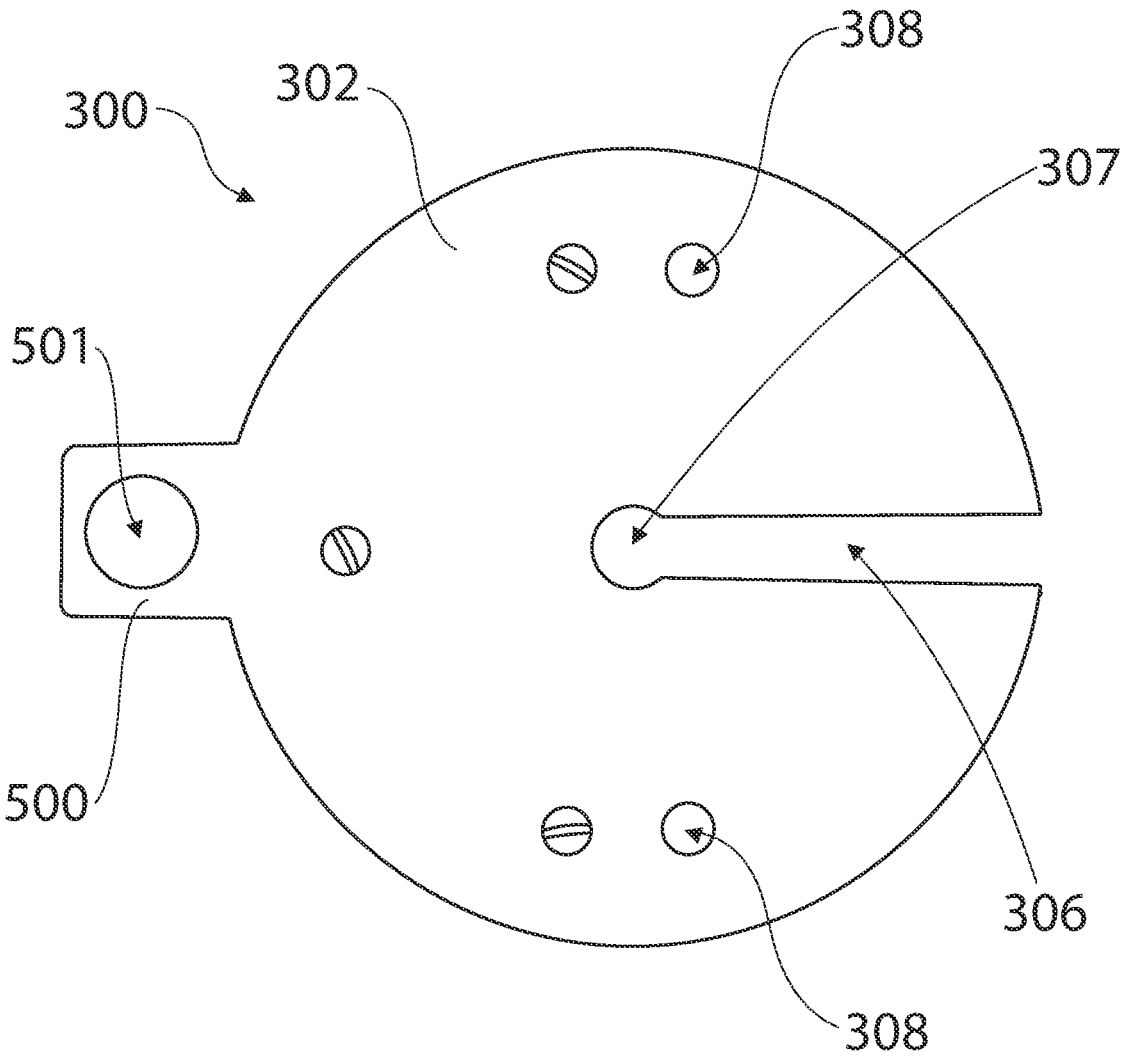
FIG. 9 is a side view of the second cover portion showing the side wall.

FIG. 9 is a side view of the second cover portion 300 showing one of the two side walls 302. The side wall 302 has a shape of a circle with a square handle 500 with the finger hole 501 attached to its outer edge. The slit 306 has a length of the radius of the circle shape. The slit 306 is of width to allow shaft 800 (shown in FIG. 1) to slide through and into the aperture 307. The width of slit 306 is smaller than the diameter of the aperture 307 to allow for forced fitting of the shaft 800, which prevents rotation of the wire spool cover 100. The slit 306 may be tapered so it is larger in width towards the edge of the side wall 302 but does not need to be. The aperture 307 is placed in the center of the side wall 302. The aperture 307 is designed to line up with the spindle of the spool of wire 700 (shown in FIG. 1). The side wall 302 is attached to the outer wall 301 (not shown in FIG. 9) by three screws. Screws are preferred as they allow for easy removal and attachment of side wall 302, which allows for switching out side walls 302 with different aperture 307 sizes to accommodate for differing shaft 800 sizes. There are two holes 308, or depressions 308, designed to receive and hold the ridges 208 (not shown in FIG. 9) of the side wall 202 of the first cover portion 200. More than three screws may be used, and other means of attachment known in the art may be used. Other means and shapes of depression may be used.

Figure 10:
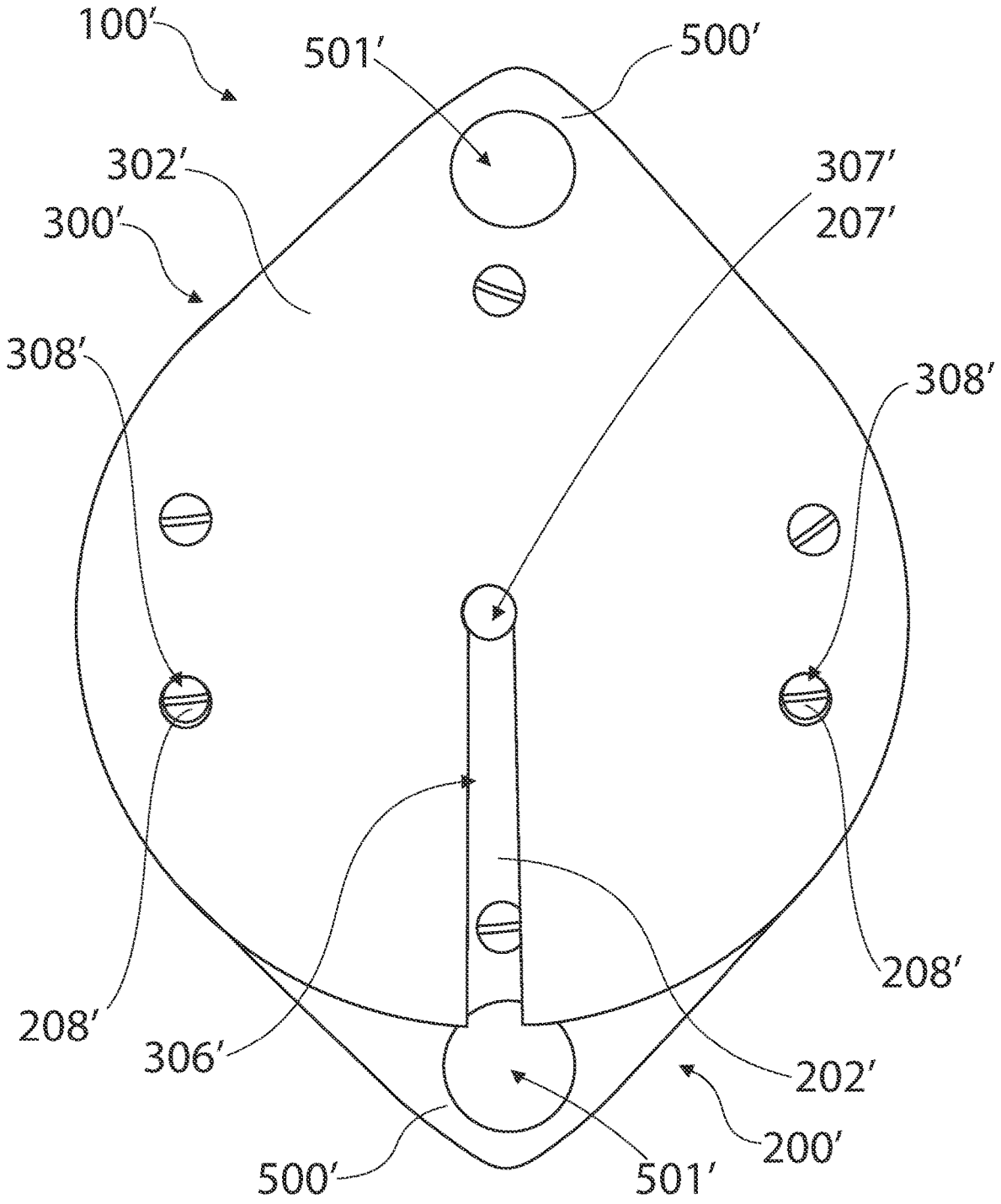
FIG. 10 is an alternative embodiment side view showing side walls of the spool cover.

FIG. 10 is an alternative embodiment side view showing one of the side walls 302' of the second cover portion 300' overlapping one of the side walls 202' of the first cover portion 200', forming the wire spool cover 100'. The embodiment 100' of FIG. 10 differs slightly from the embodiment 100 of FIGS. 2-9, since the handles 500' are smooth triangular contoured and the side walls 202',302' overlap differently. These differences are permitted without departing from the scope of the invention as claimed. Further, the embodiment 100' of FIG. 10 differs slightly from the embodiment 100 of FIGS. 2-9 in that the embodiment 100 of FIG. 1 has a see-through outer wall 201 but the outer walls 201' of wire cover 100' are not necessarily see-through. As described, the side wall 302' of the second cover portion 300' has a circular body with a contoured triangular protruding portion forming the handle 500' with a finger hole 501'. The side wall 202' of the first cover portion 200' is designed similarly and has a circular body with a contoured triangular protruding portion forming the handle 500' with a finger hole 501'. Similar to FIG. 1, the slit 306' of the side wall 302' of the second cover portion 300' line up but do not overlap with the slit 206' (not shown) of the side wall 202' of the first cover portion 200'. The aperture 307' of the side wall 302' of the second cover portion 300' does overlap perfectly with the aperture 207' of the side wall 202' of the first cover portion 200' so a shaft 800 (not shown) can be force fitted. The heads of the screws 208' that serves as the ridges 208' on the side wall 202' of the first cover portion 200' is shown fitted through the holes 308', or depressions 308', of the side wall 302' of the second cover portion 300'. Besides the shape of the handles 500', the embodiment depicted in FIG. 10 function the same as that of FIGS. 1-9.

In an embodiment in accordance with this disclosure, the first cover portion 200 and the second cover portion 300 may be comprised of a plurality of cover portions adapted for enclosing a spool of wire 700 mounted on a shaft 800 without requiring clasps, hinges, pins, or other hardware to connect the plurality of cover portions to each other.

In an embodiment in accordance with this disclosure, only one of the first cover portion 200 and the second cover portion 300 may be adapted to attach to the shaft.

As an example of the method for installing the wire spool cover 100, the wire spool cover 100 is installed over the wire spool 700 already mounted on a shaft 800 by 1) encompassing a portion of the wire spool 700 with the first cover portion 200 and attaching the at least one side wall 202 of the first cover portion 200 to the shaft 800 adjacent one of the opposing side of the spool of wire 700; 2) encompassing an another portion of the wire spool 700 with the second cover portion 300 and attaching the at least one side wall 302 of the second cover portion 300 to the shaft 800 adjacent one of the opposing side of the spool of wire 700. If the spool cover 100 uses the slit 206, 306 and the aperture 207, 307 to attach to the shaft 800, the method can also have additional steps of sliding the shaft 800 through each of the slits 206, 306 and force-fitting the shaft 800 through the apertures 207, 307. If the spool cover 100 has an opening 305, there may be an additional step of threading an end of the wire 703 through the opening 305 on the outer wall 301 of the second cover portion 300. If the spool cover 100 has overlapping side walls 202, 302 with at least one depression 308 on the side wall 302 of the second cover portion 300 and at least one ridge 208 on the side wall 202 of the first cover portion 200, then there may be an additional step of overlapping and snapping in the at least one ridge 208 into the at least one depression 308 to combine the spool cover 100. If the wire spool cover 100 has a particularly shaped mating portion 204 on the at least one side wall 202 of the first cover portion 200 and a complementarily shaped mating portion 304 on the at least one side wall 302 of the second cover portion 300, then there may be an additional step of matingly interacting the particularly shaped mating portion 204 with the complementarily shaped mating portion 304 to combine the first cover portion 200 with the second cover portion 300 to form the spool cover 100.

Figure 11A:
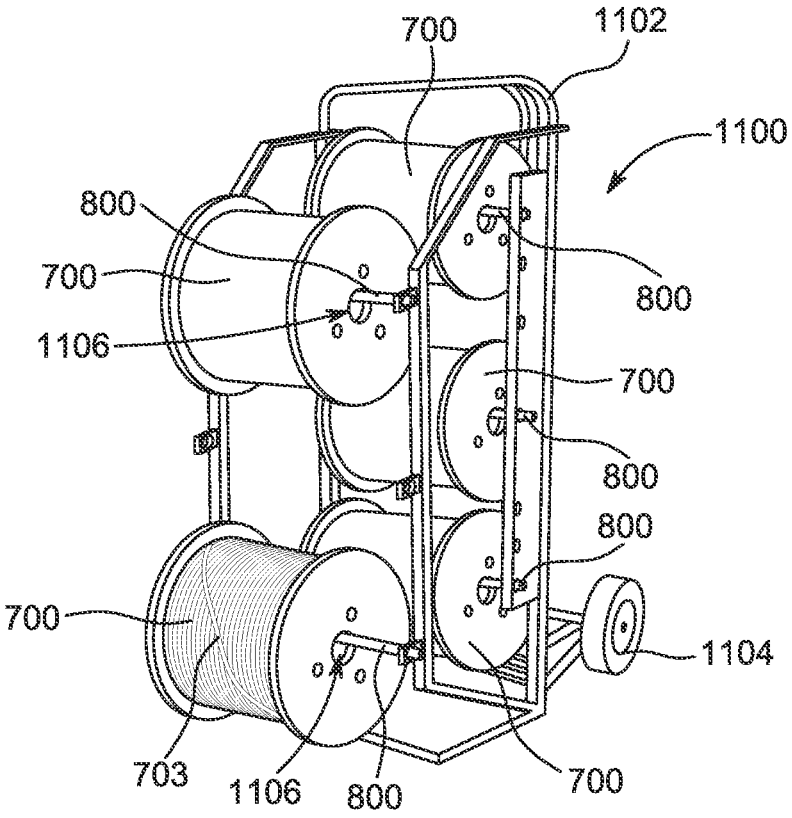
FIG. 11A is a front right perspective view of a prior wire spool caddy adapted for carrying a plurality of wire spools around a job site as with a hand truck.

Referring to FIG. 11A, there is shown a front right perspective view of a prior wire spool caddy 1100 adapted for carrying a plurality of wire spools 700 around a job site as with a hand truck 1102 with wheels 1104 thereon. The caddy 1100 with wheels like a hand truck is needed because larger spools of wire 700, e.g., (between 1000 and 2500 feet) 8-gauge and larger are too heavy to move around without wheels. Thus, for example a wire spool 700 may be about 63 pounds for 1500 feet of 8-gauge wire. But smaller spools of wire 700, e.g., for 250 ft (22 gauge) or 500 ft (14 gauge) may be maneuvered with hand-held caddies or wheeled caddies. Thus, in order to carry up to five spools of wire 700 as shown, a wheeled hand-truck-type device is necessary to more easily maneuver the caddy around a job site. Further, such a caddy 1100 is one type of environment in which the wire spool covers 200, 200', and other spool covers described hereafter, need to be able to operate in, that is a "close quarter"-type of environment with multiple wire spools 700 on a single caddie 1100, wherein the spool covers 200, 200', and others described herein, need to have a slim profile to be able to all fit on a single caddie without interfering with each other and the operation of the spools of wire on the caddie.

Figure 11B:
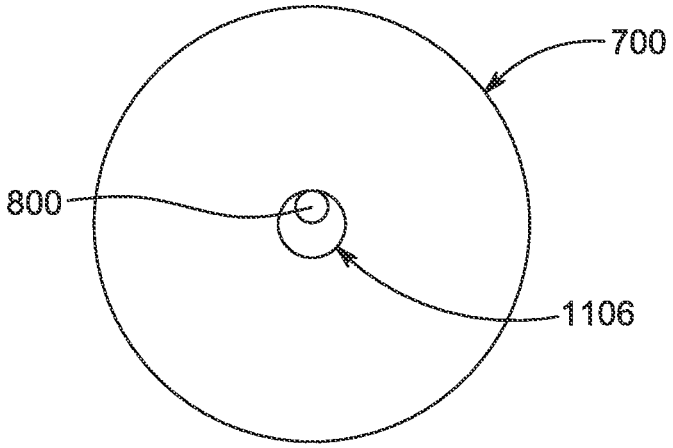
FIG. 11B is a right-side perspective view of a prior wire spool on a shaft illustrating how the diameter of a central hollow tube of the wire spool is larger than the diameter of the shaft causing the wire spool to sit off-center compared to the shaft.

Referring now to FIG. 11B, there is shown a right-side perspective view of a prior wire spool 700 on a shaft 800, illustrating how the diameter of a central hollow tube 1106 of the wire spool 700 is larger than the diameter of the shaft 800 causing the central hollow tube of the wire spool to sit off-center compared to the location of the shaft. This condition, resulting from the fact that the inner diameter of the hollow tubes 1106 of wire spools 700 are larger than the diameters of spool caddy shafts 800, has caused the spool covers 200, 200', and other spool covers described hereafter, to not remain centered relative to the shaft 800 and wire spools 700, thus causing undue wear and tear on the spool covers and less desirable functionality of the spool covers when covering spools to dispense an end of the wire 703 therefrom.

Accordingly, to help rectify this problem of lack of centering of a spool of wire 700 on a shaft 800 within spool covers 100, 100', in FIGS. 12B-12C there is introduced and further shown an embodiment of a wire spool cover having a modified second cover portion 300" (see FIG. 12B), and a modified first cover portion 200" (see FIG. 12C), wherein in addition to the cover portions being able to be readily refurbished, or rebuilt, as further described below, there is further provided a multi-piece collett 1208 (see FIG. 12A) attached to the second cover portion 300" by gluing, rivets, bolts, plastic bonding, integral injection molding, or other fastening means, for centering purposes.

Figure 12A:
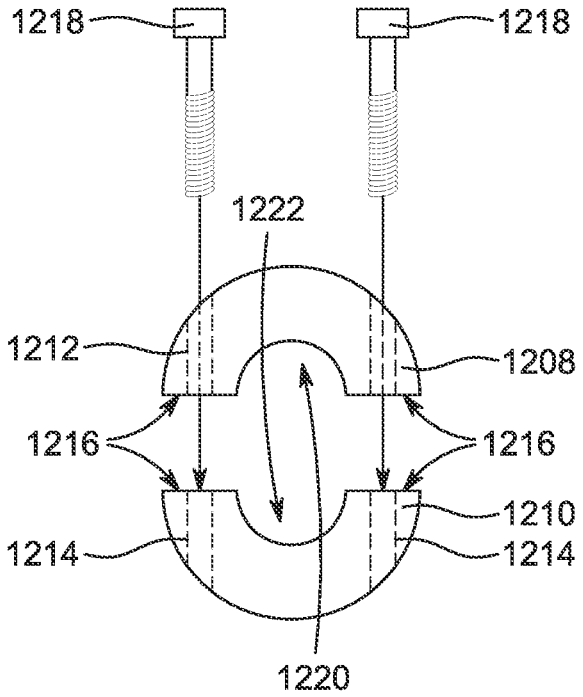
FIG. 12A is a side view of a two-piece collett with threaded through holes and tap screws adapted to assist in centering a wire spool on a shaft and relative to a spool cover in accordance with an aspect of the disclosure.

The rebuildable spool cover comprised of cover portions 200" and 300" is generally similar to the spool covers 100, 100' in that the first and second cover portions 200", 300", respectively, are each also comprised of side walls 202", 302", respectively, and an outer wall 201", 301", respectively (not shown in FIGS. 12A-12C, but also similar to outer walls 201'", 301'" shown in FIG. 13), wherein one of the outer walls (e.g., outer wall 301") would define an opening for dispensing wire 703 therethrough. Further, similarly to spool covers 100, 100', rebuildable spool cover portions 200", 300" comprise an alternative handle 500" that is larger and therefore easier to grasp during operation. Further, similar to prior versions of the spool cover, the first cover portion 200" comprises a particular shaped mating portion 204" adapted to fit within an indentation and mating with an edge (neither of which are shown in FIGS. 12A-12C, but similar to that shown at 204, 304, and 404 of FIG. 3). Further, similarly to cover portions 200, 300 of FIG. 3, as shown in FIGS. 12B and 12C, respectively, first cover portion 200" and second cover portion 300" also comprise slits 206", 306", respectively, that terminate at an aperture 207", 307", respectively, of sufficient diameter size to accommodate the shaft 800 when the portions 200" and 300" are installed on the shaft. These apertures 207", 307" may be of a looser or tighter fit depending on the desired characteristics of the cover portions, and if a looser fit is desired, then colletts 1208, 1210 may be implemented to help center the cover portions 200", 300" on the shaft as further described herein. The slits 206" and 306" need not be tapered as indicated in another embodiment herein, in part because the colletts 1208, 1210 help to hold the cover portions 200", 300" on the shaft 800 and covering the wire spool 700.

Figure 12B:
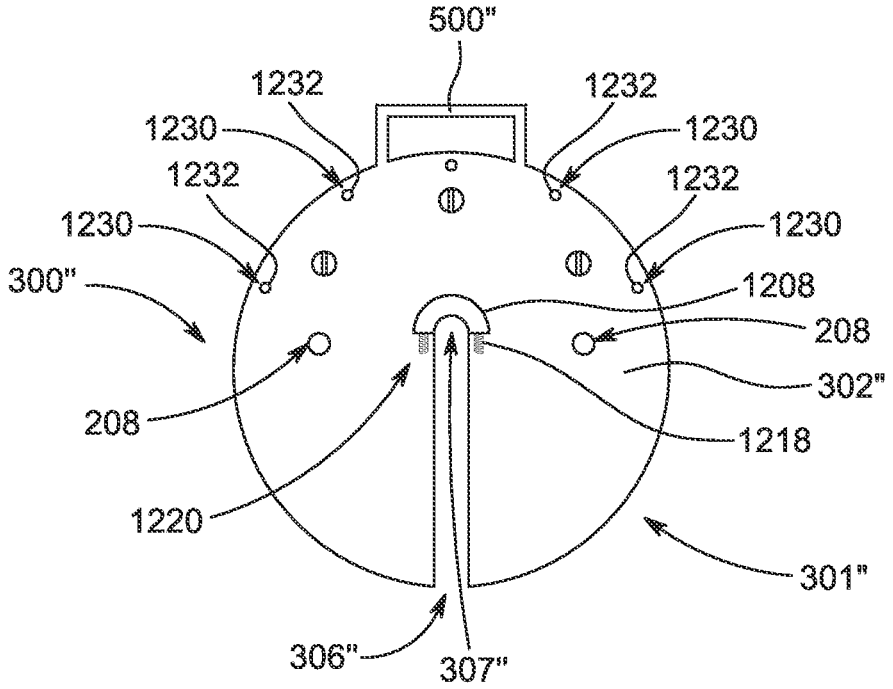
FIG. 12B is a side view of a portion of a rebuildable spool cover having a handle and with a portion of the collett of FIG. 12A attached to a side wall portion of the spool cover with an opening of the collett positioned coextensive with a central aperture of the spool cover.
Figure 12C:
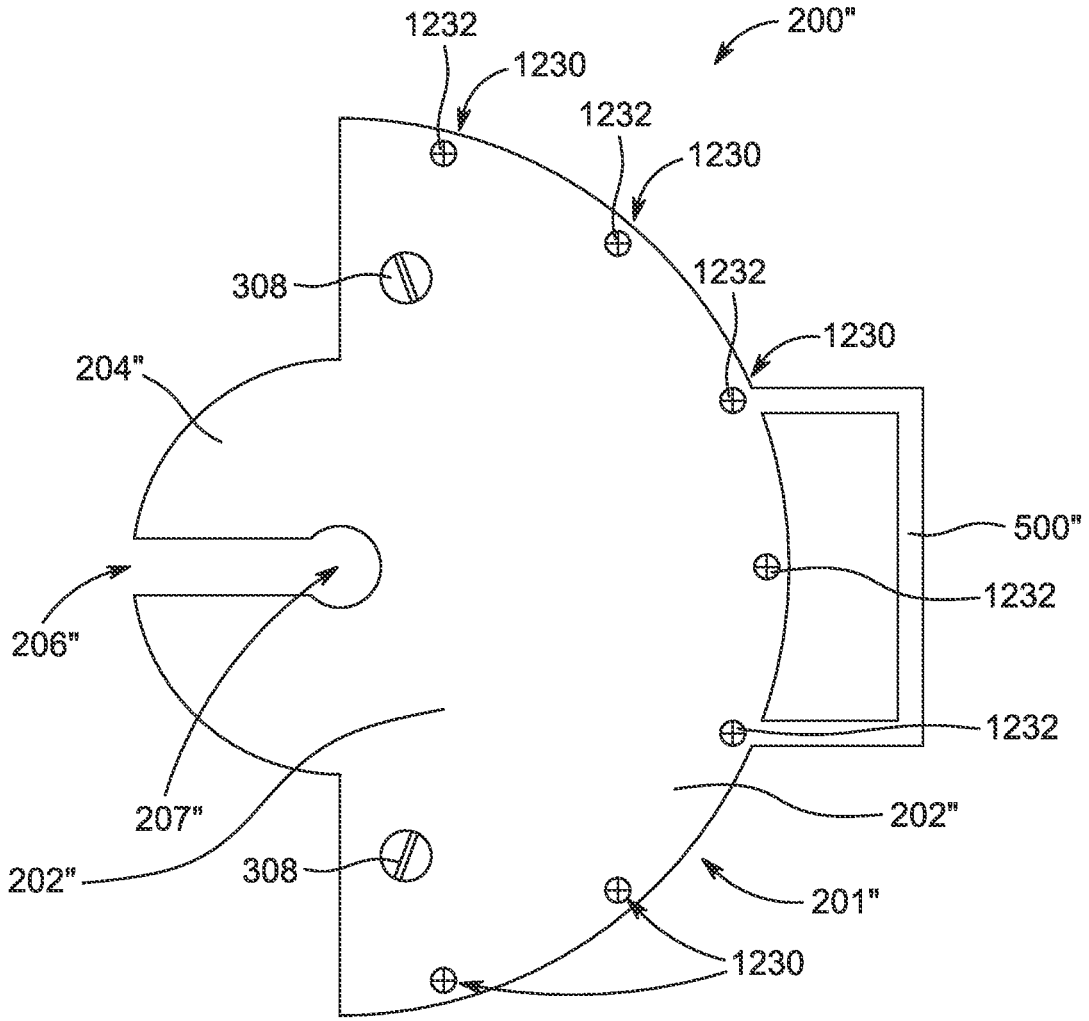
FIG. 12C is a side view (i.e., with the spool cover rotated 90 degrees) of a mating portion of the rebuildable spool cover portion shown in FIG. 12B.
Figure 15A:
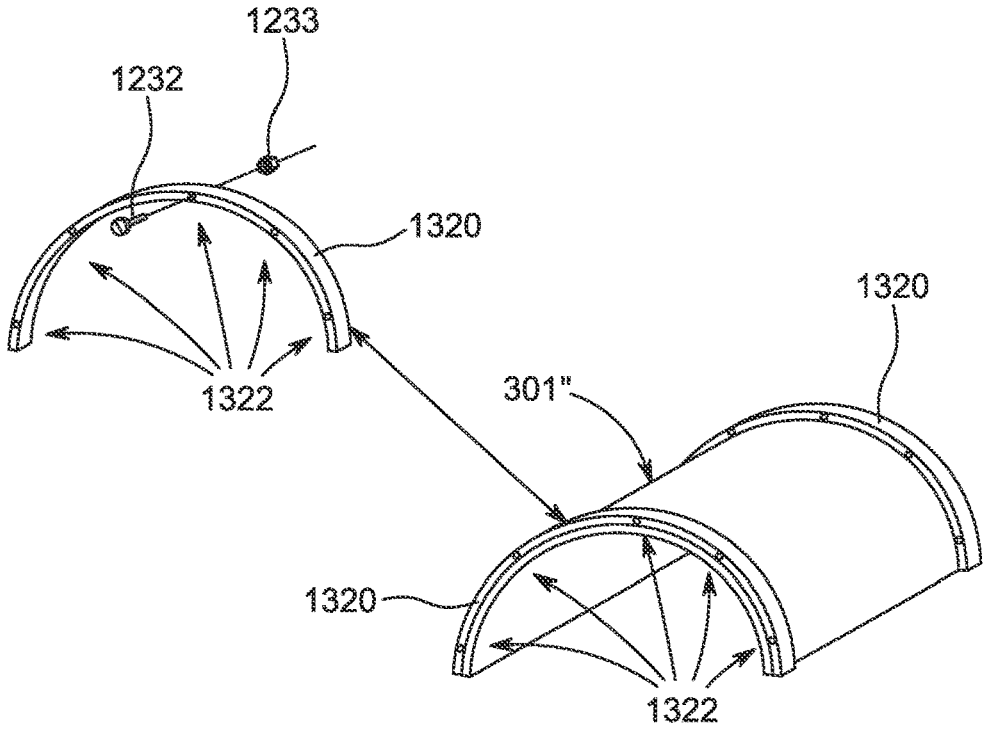
FIG. 15A is a perspective view of an outer wall portion of a rebuildable first wire spool cover portion (adaptable to a number of different styles of spool covers described herein) together with a detail of an edge connector system having defined therein screw holes for attachment to this and other outer wall portions as with gluing adjacent edge portions of the outer wall portions, the edge connector screw holes adapted for alignment with screw holes from the side walls and for receiving screws secured by nuts during installation of the side walls at the lateral edges of the outer wall.
Figure 15B:
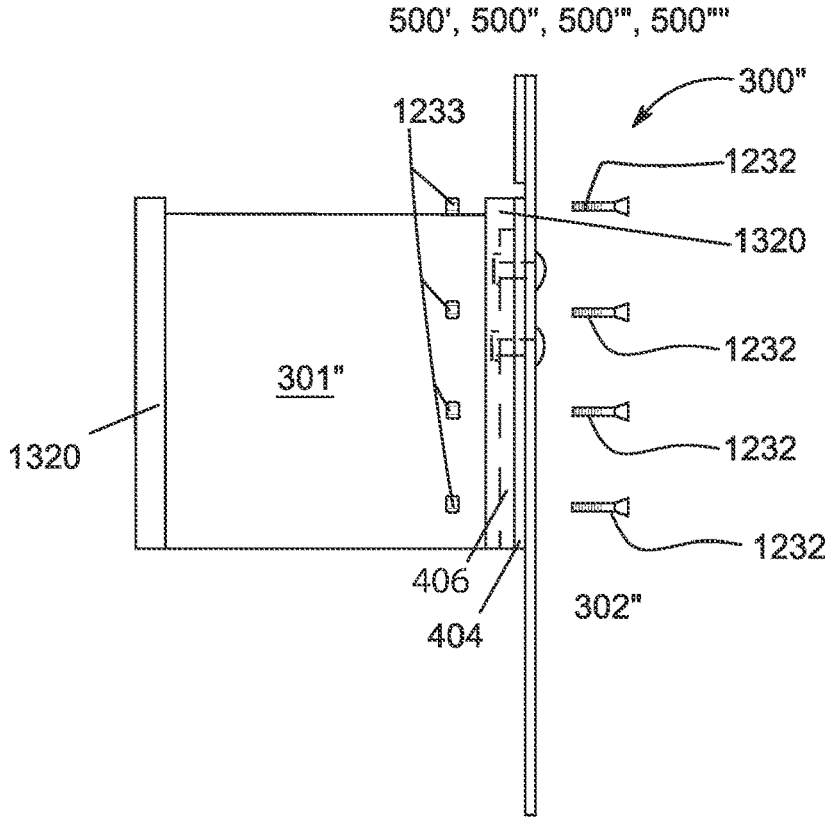
FIG. 15B is a front view showing the right-side wall sandwich construction of a rebuildable spool cover being adapted to being attached to a right edge connector of an outer wall portion of a spool cover portion, and showing a left edge connector without a left side wall being attached yet.
Figure 15C:
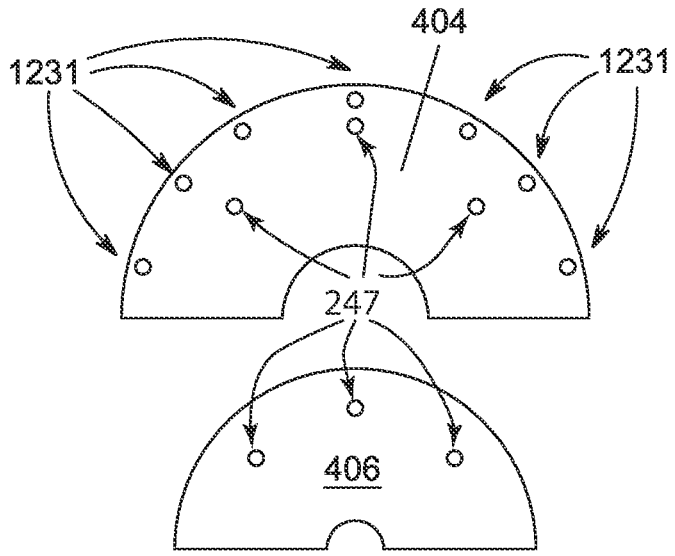
FIG. 15C is a side view of inner, intermediate, and outer side wall portions of side wall construction of a rebuildable spool cover side wall, and their respective bolt hole patterns, for forming overlapping slot-type indentation capability for side walls of rebuildable spool covers.
Figure 15C:
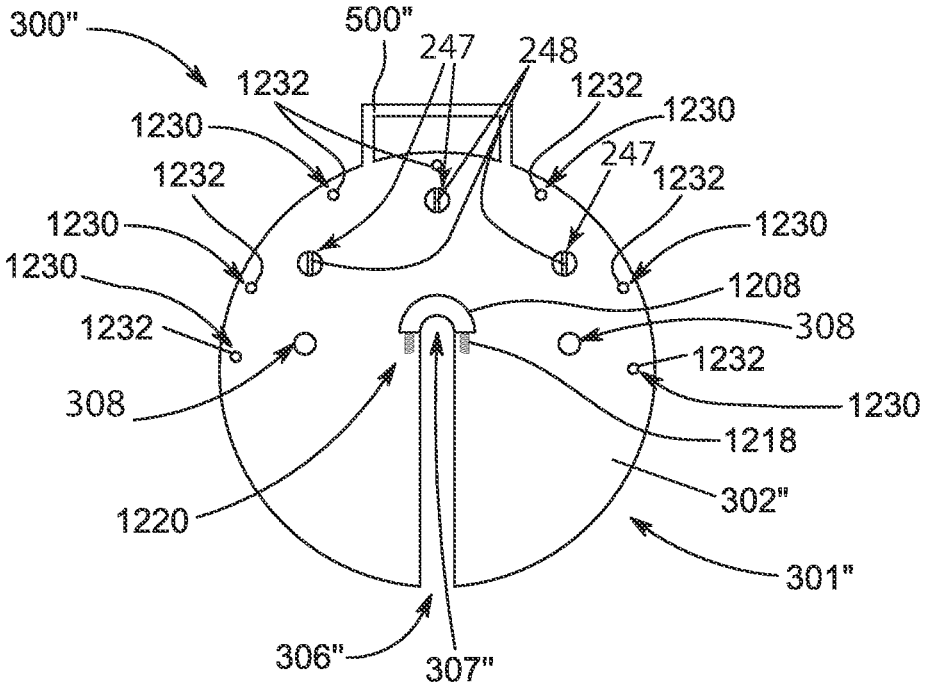
Figure 16:
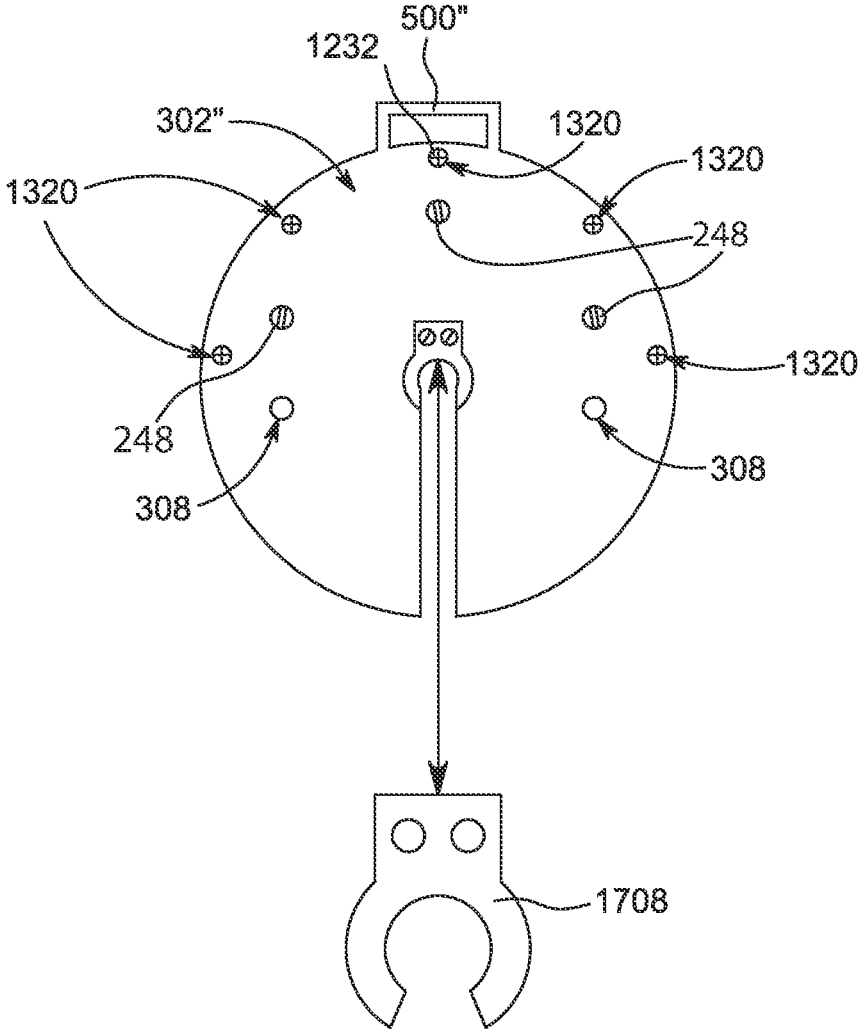
FIG. 16 is a side view of a side wall of a rebuildable wire spool cover similar to that of FIG. 12B, but with an alternative snap-on centering collett adapted for attachment to the side wall of the wire spool cover.

To help make them re-buildable, the side walls 202", 302" of the cover portions 200", 300", respectively, each define a plurality of holes 1230 with screws 1232 installed therein to hold the side walls 202", 302" to the outer cover portions 201" 301", respectively, by way of edge members (not shown in FIGS. 12B-C but as further described herein in connection with FIGS. 15A-C). This way, after either the outer walls 201", 301", or the side walls 202", 302" wear out, or break, they may be replaced by unscrewing the screws 1232, installing the new wall(s), and reinstalling the screws into the edge members.

In FIGS. 15A-C there are shown perspective detail views of outer wall portions 201", 201'", 201'", 301", 301'", 301"" of first and second rebuildable spool cover portions 200", 200'", 200"", 300", 300'", 300"" (see also FIGS. 12A-C, 13, 14B, 16, and 17) together with a detail of the edge connector system, or hubs, 1320 comprised of a molding, or hub, 1320 adapted for attachment to the outer wall portion as with gluing, screwing, riveting, or otherwise bonding adjacent edges of the outer wall portion, the molding defining a plurality of holes 1322 adapted for being aligned with holes 1230 of side walls and 1231 of an inner indentation forming member 404, such that screws 1232 and nuts 1233 may be used to secure the side walls to the outer walls at the lateral edges of each outer wall. An additional inner wall 406, shown in FIG. 15C is used to create an indentation 304 similar to that shown in FIGS. 3 and 17. Holes 247 are defined in the respective portions 404, 406, and 302 to allow sandwich construction using screws 248.

Referring further to FIGS. 12A and 12B the first collett portions 1208 are preferably attached, as with gluing, nuts and bolts, welding or other adhesive means, to side wall portions 302" of the second spool cover portion 300" with openings 1220 of the first collett portions positioned coextensive with central apertures 307" of the spool cover portions 300". The colletts are, in this embodiment, two-piece colletts 1208, 1210, with corresponding aligned threaded through holes 1212, 1214, respectively, defined in each of the collett portions 1208, 1210. The threaded through holes 1212, 1214 are adapted to be aligned as shown in FIG. 12A when each of the collet portions 1208, 1210 are aligned (there being two colletts for each side wall of the wire spool cover), such that when the collett portions are installed on a shaft 800, central, intermediate, engagement, or interface, surfaces 1216 are adapted to abut, or interface, or be closely adjacent one another, as the portions 1208, 1210 of the collett are installed and tightened onto the shaft. Thus, the set screws 1218 are adapted to be screwed into the through holes 1212, 1214 and tightened to assist in centering the wire spool 700 on the shaft 800 and relative to the spool cover 200, 200', or other spool cover further described hereafter and in accordance with an aspect of the disclosure.

The opening 1220 of the first collett portion 1208 is adapted for attachment with the first collett portion's opening 1220 being substantially aligned with the aperture 307" of the sidewall 302", the opening 1222 of the second collett portion 1210 is also adapted to close down on the shaft 800 when the two collet portions 1208, 1210 are closed together. Thus, after installation of the first cover portion 300, 300', 300", or other first cover portion described hereafter, onto a shaft 800 to at last partially cover a wire spool 700, the second collet portion 1210 may be screwed into place by installing and tightening the set screws 1218 through aligned through holes 1212, 1214 of the two collet portions 1208, 1210, in order to center the wire spool 700 on the shaft, and such that the wire spool's flanges rub on the cover portion 300, 300', 300", or other first (lower) cover portion described herein, to allow dispensing of wire without tangling according to a purpose of the spool covers of the present disclosure.

Thus, the plurality of collett portions 1208, 1210 (i.e., a plurality of collett portion pairs 1208, 1210, preferably there being one collett pair for residing adjacent and attached to each side wall of the second cover portion 300") are adapted for installation relative to each of the side walls 302, 302', 302", etc., of each of the cover portions 300, 300', 300", and other cover portions described herein, the first collett portions 1208 being preferably adapted to be attached on side walls 302, 302', 302", etc., of second cover portions 300, 300', 300" for example with gluing, welding, screwing, riveting, or otherwise bonding thereon as shown in FIG. 12B. The second collett portion 1210 is then adapted for being secured to the first collett portion 1208 by way of the set screws 1218. Thus, the second collett portion need not be attached to a side wall 202" or 302"—the first collett portion 1208 may thus be glued on for covering lighter spools, or the first collet portion 1208 may be bolted on for covering heavier spools.

Figure 13:
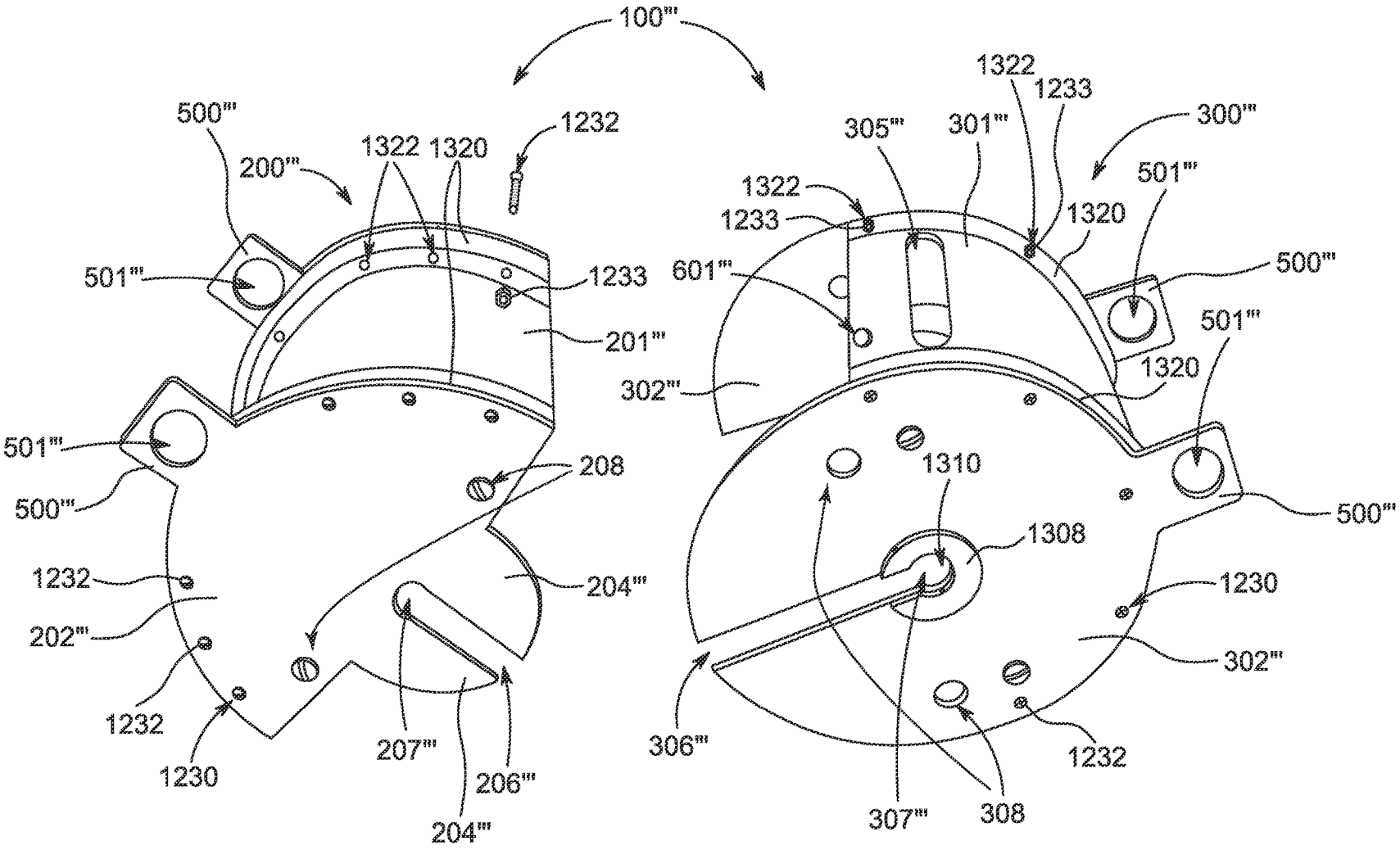
FIG. 13 is a perspective view of both portions of a rebuildable spool cover comprising two separated cover portions adapted to be mated together, having an alternative handle, showing an opening for dispensing wire, and showing an alternative embodiment collet attached to a side wall of one of the spool cover portions.

Referring now to FIG. 13, there is provided a perspective view of a complete, rebuildable spool cover 100'" comprising two cover portions, second cover portion 300'" and first cover portion 200'", having an alternative handle 500'", showing an opening 305'" for dispensing wire, and showing an alternative embodiment reinforcing collet 1308 attached to a side wall 302'" of the first spool cover portion 300'".

The rebuildable spool cover 100'" comprised of cover portions 200'" and 300'" is generally similar to the spool covers 100, 100', 100" in that the first and second cover portions 300'", 200'", respectively, are each also comprised of side walls 302'", 202'", respectively, and an outer wall 301'", 201'", respectively, wherein one of the outer walls (e.g., outer wall 301'") defines an opening 305'" for dispensing wire 703 therethrough. Further, similarly to spool covers 100, 100', 100", rebuildable spool cover portions 200'", 300'" of spool cover 100'" each preferably comprise an alternative handle 500'" that is comprised of a rectangular tab 500'" defining a finger hole 501'" to allow gripping of the handle. Further, similar to prior versions of the spool cover, the first cover portion 200'" comprises a particular shaped mating portion 204'" adapted to fit within an indentation and mating with an edge (neither of which are shown in FIG. 13, but similar to that shown at 204, 304, and 404 of FIG. 3). Further, similarly to cover portions 200, 300 of FIG. 3, as shown in FIG. 13, first cover portion cover 300'" and second cover portion 200" also comprise slits 306'", 206'", respectively, that terminate at an aperture 307'", 207'", respectively, of sufficient diameter size to accommodate the shaft 800 when the cover portions 200''' and 300''' are installed on the shaft. These apertures 207''', 307''' may be of a looser or tighter fit depending on the desired characteristics of the cover portions, and if a looser fit is desired, alternative colletts 1308 may be implemented to help center the cover portions 200''', 300''' on the shaft as further described herein. The slits 206''' and 306''' need not be tapered as indicated in another embodiment herein, in part because the colletts 1308 help to hold the cover portions 200''', 300''' on the shaft 800 and covering the wire spool 700.

To help make them rebuildable, the spool cover portions 200''' and 300''' each comprise an edge member, or hub, 1320 defining a plurality of screw holes 1230 therein adapted to receive screws 1232 through holes 1230 aligned with and defined in each side member 202''', 302''', the screws 1232 preferably being held in place with small nuts 1233. Thus, side members 202''' and 302''' are removable to allow refurbishing of the side members and/or the outer members 201''', 301'''.

The collett 1308 of FIG. 13 is more of a reinforcing member, preferably made of plastic, or rubber, and having an inner diameter 1310 adapted to snap onto a shaft 800 and to hold the shaft snug, such as may be appropriate for lighter weight spools 700.

Figure 14A:
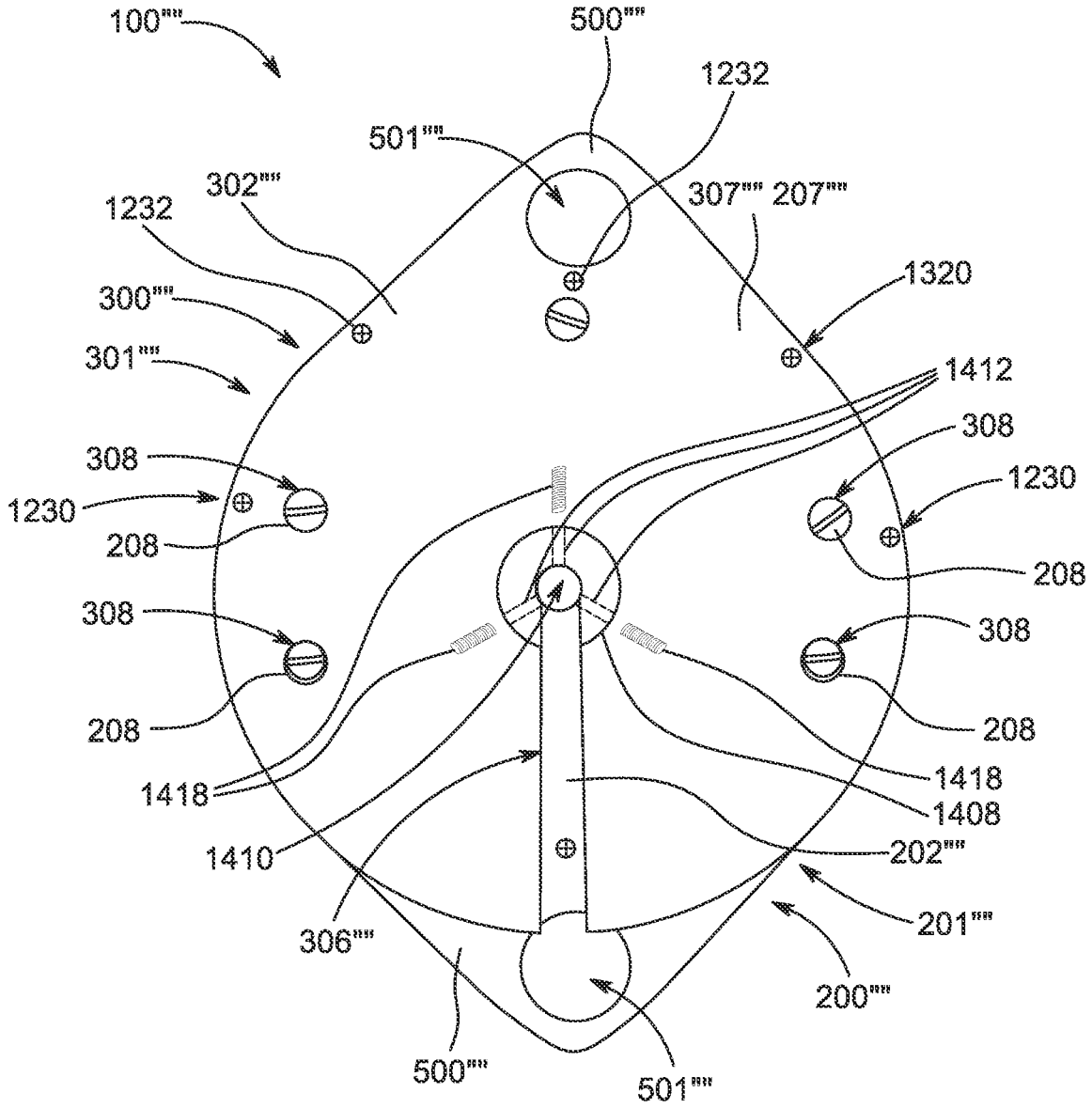
FIG. 14A is a side view of both portions of a rebuildable spool cover comprising two mating cover portions mated together, having yet another alternative handle, showing the alternative embodiment collett attached to a side wall of one of the spool cover portions.

FIG. 14A shows a side view of an alternative, complete, rebuildable spool cover 100'''' comprising two cover portions, first cover portion 300'''' and second cover portion 200'''', each cover portion having an alternative handle 500'''', showing an opening (not shown in FIG. 14A) similar to that shown at 305''' of FIG. 13 for dispensing wire, and showing an alternative embodiment collet 1408 attached to a side wall 302'''' of the first spool cover portion 300''''.

The rebuildable spool cover 100'''' comprised of cover portions 200'''' and 300'''' is generally similar to the spool covers 100, 100', 100'', 100''' in that the first and second portions 200'''', 300'''', respectively, are each also comprised of side walls 202'''', 302'''', respectively, and an outer wall 201'''', 301'''', respectively (not shown in FIG. 14A, but also similar to outer walls 201''', 301''' shown in FIG. 13), wherein one of the outer walls (e.g., outer wall 301'''') define an opening (similar to opening 305''' of FIG. 13) for dispensing wire 703 therethrough. Further, similarly to spool covers 100, 100', 100'', 100''', rebuildable spool cover portions 200'''', 300'''' comprise an alternative handle 500'''' that comprises a rounded tab 501'''' that allows grasping the cover portions during installation and/or removal of the cover portions from a shaft 800 and spool of wire 700. Further, similar to prior versions of the spool cover, the first cover portion 200'''' comprises a particular shaped mating portion 204'''' adapted to fit within an indentation and mating with an edge (neither of which are shown in FIG. 14A, but similar to that shown at 204, 304, and 404 of FIG. 3). Further, similarly to cover portions 200, 300 of FIG. 3, as shown in FIG. 14A, first portion 200'''' and second portion 300'''' also comprise slits 206'''' (not shown), 306'''', respectively, that terminate at an aperture 207'''' (not shown), 307'''', respectively, of sufficient diameter size to accommodate the shaft 800 when the portions 200'''' and 300'''' are installed on the shaft. These apertures 207'''', 307'''' may be of a looser or tighter fit depending on the desired characteristics of the cover portions, and if a looser fit is desired, then colletts 1408 may be implemented to help center the cover portions 200'''', 300'''' on the shaft and relative to the cover portions as further described herein. The slits 206'''' and 306'''' need not be tapered as indicated in another embodiment herein, in part because the colletts 1408 help to hold the cover portions 200'''', 300'''' on the shaft 800 and covering the wire spool 700.

The alternative handles 500'''' of the rebuildable spool cover portions 200'''' and 300'''' each comprise a rounded off tab 500'''' defining a finger hole 501''''. The handles 500'''' make it easier to install, and especially to remove, the cover portions 300'''' and 200'''' from installation on a shaft 800 and from covering a spool 700.

To help make them rebuildable, the spool cover portions 200'''' and 300'''' each comprise an edge member (not shown in FIG. 14A) similar to those shown in FIG. 13 defining a plurality of screw holes therein adapted to receive screws 1232 through holes 1230 aligned with and defined in each side member 202'''', 302'''', the screws 1232 being held in place with small nuts (not shown) similar to those of FIG. 13. Thus, side members 202'''' and 302'''' are removable to allow refurbishing of the side members and/or the outer members 201'''', 301''''.

Figure 14B:
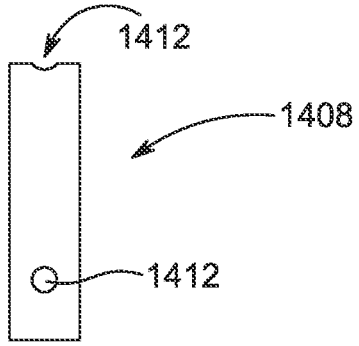
FIG. 14B is a front view of the alternative embodiment collett shown in FIG. 14A.

The colletts 1408 shown in FIGS. 14A and 14B comprises a semi-annular body 1408 having threaded through holes 1412 defined therein adapted to receive set screws 1418, the body having an inner diameter 1410 adapted to engage a shaft 800 so as to allow the set screws 1418 to be tightened onto the shaft to hold it snug in order to allow the spool 700 to spin freely on the shaft 800 within the cover member 100'''' to allow dispensing of wire without tangling. This type of collett 1408 is well suited for slightly larger wire spools, such as 2500-foot wire spools (e.g., 12-gauge or 14-gauge wire), since these are heavier and require greater holding for centering as provided by the set screws 1418. On the other hand a collett such as collet 1308 may be better suited for a lighter wire spool, such as a 500 foot wire spool or smaller, where the snapping-on feature of that collett would be sufficient to hold the lighter spool centered and in place.

Similar to first cover portion 200, the side walls of the first cover portions 200'', 200''', 200'''' each comprises a plurality of the screws 208 (or other protrusions or ridges) used as the ridges 208 to connect with the holes 308 of the side walls of the second cover portions 300'', 300''', 300'''' when the first and second cover portion side walls are aligned and overlapped, as seen and described in connection with FIGS. 1-10, 12B-C, 13, 14A, 15C, and 16, to assist in holding the combined first cover portions and the second cover portions together in forming the wire spool covers.

Figure 17:
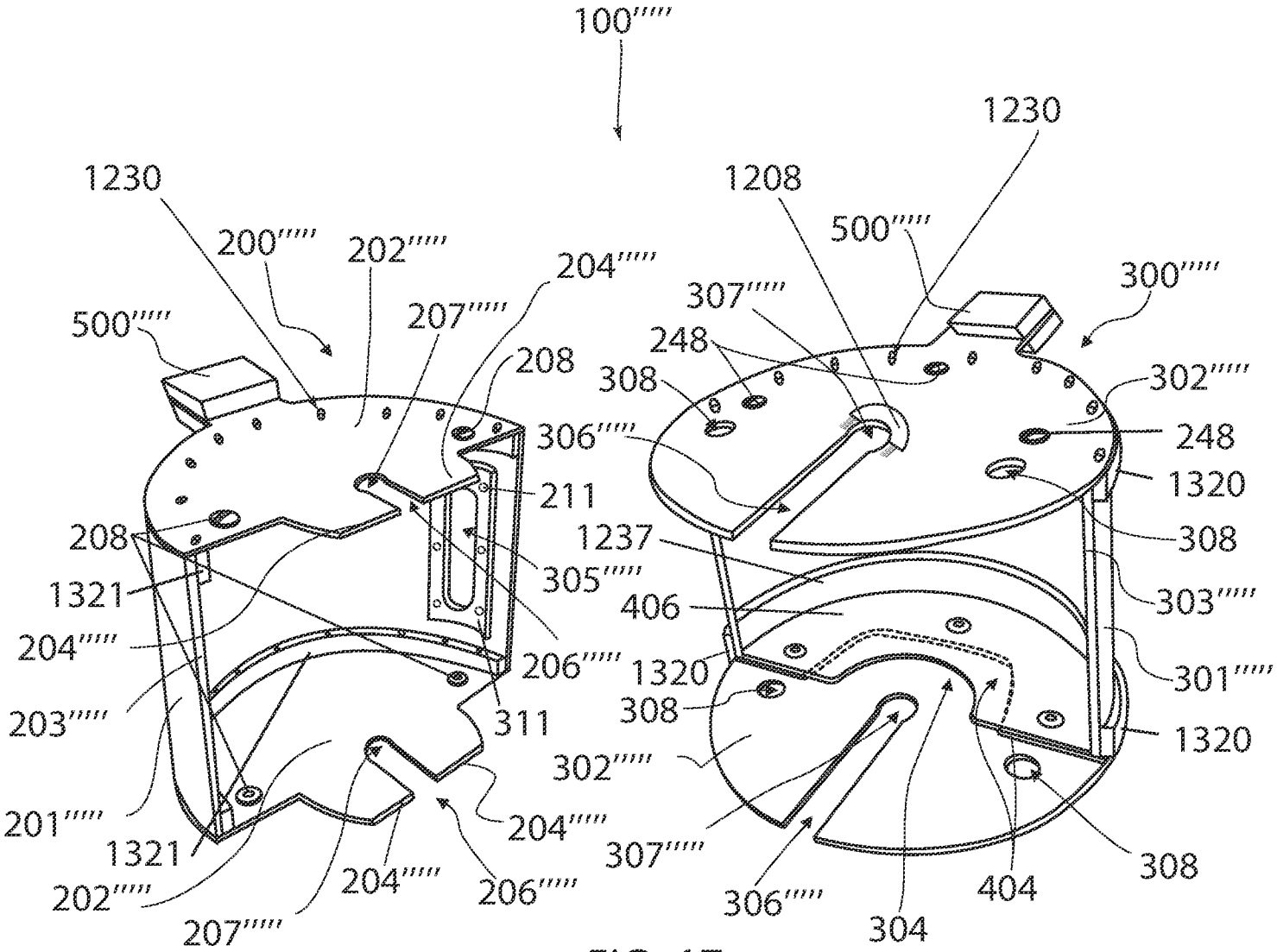
FIG. 17 is a perspective view of first and second cover portions of an alternative embodiment wire spool cover (shown apart but adapted for being mated together)

Referring to FIG. 17, there is shown a perspective view of first and second spool cover portions 300''''', 200''''', respectively, of an alternative rebuildable wire spool cover 100''''', having alternative handles 500''''', showing a reinforced opening 305''''' for dispensing wire, and showing the collet 1208 attached to a side wall 302''''' of the first spool cover portion 300'''''.

The rebuildable spool cover 100''''' comprised of cover portions 200''''' and 300''''' is generally similar to the spool covers 100, 100', 100'', 100'''' in that the first and second cover portions 300''''', 200''''', respectively, are each also comprised of side walls 302', 202''', respectively, and an outer wall 301''''', 201''''', respectively, wherein one of the outer walls (e.g., outer wall 301''''') defines an opening 305''''' for dispensing wire 703 therethrough. The opening 305''''' may be advantageously reinforced with a reinforcing member 311 held in place with pop rivets or small nuts and bolts 211. Further, similarly to spool covers 100, 100', 100'', 100''', 100'''', rebuildable spool cover portions 200''''', 300''''' of spool cover 100''''' preferably comprises an alternative handle 500''''' that is comprised of a rectangular tab 500''''' having a protruding rectangular cuboidal portion 500'''' to allow gripping of the handle (alternatively, this handle 500'''' could be bulbous). Further, similar to prior versions of the spool cover, the second cover portion 200'''' comprises a particular shaped mating portion 204'''' adapted to fit within an indentation 304'''' and mating with an edge 404 formed by side member portion 404 similar to that shown at 204, 304, and 404 of FIG. 3). Further, similarly to cover portions 200, 300 of FIG. 3, as shown in FIG. 17, second cover portion cover 200'''' and first cover portion 300'''' also comprise slits 206'''', 306'''', respectively, that terminate at an aperture 207'''', 307'''', respectively, of sufficient diameter size to accommodate the shaft 800 when the cover portions 200'''' and 300'''' are installed on the shaft. These apertures 207'''', 307'''' may be of a looser or tighter fit depending on the desired characteristics of the cover portions, and if a looser fit is desired, alternative collett portions 1208, 1210 may be implemented on each sidewall 302'''' of cover portion 300'''' to help center the cover portions on the shaft as further described herein. The slits 206'''' and 306'''' need not be tapered as indicated in another embodiment herein, in part because the collett portions 1208, 1210 help to hold the cover portions 200'''', 300'''' on the shaft 800 and covering the wire spool 700.

To help make them rebuildable, the spool cover portions 200'''' and 300'''' each comprise an edge member, or hub, 1320, 1321, respectively defining a plurality of screw holes 1230 therein adapted to receive screws 1232 through holes 1230 aligned with and defined in each side member 202'''', 302'''', the screws 1232 preferably being held in place with small nuts 1233. Thus, side members 202'''' and 302'''' are removable to allow refurbishing of the side members and/or the outer members 201'''', 301''''. Unlike with some other embodiments, edge member, or hub, 132 may be on the inside of outer wall member 201'''', as this may allow the cover portion 200'''' (together with the hub 1321 on outer wall member 201'''') to better nest inside of the cover portion 300''''.

Figure 19:
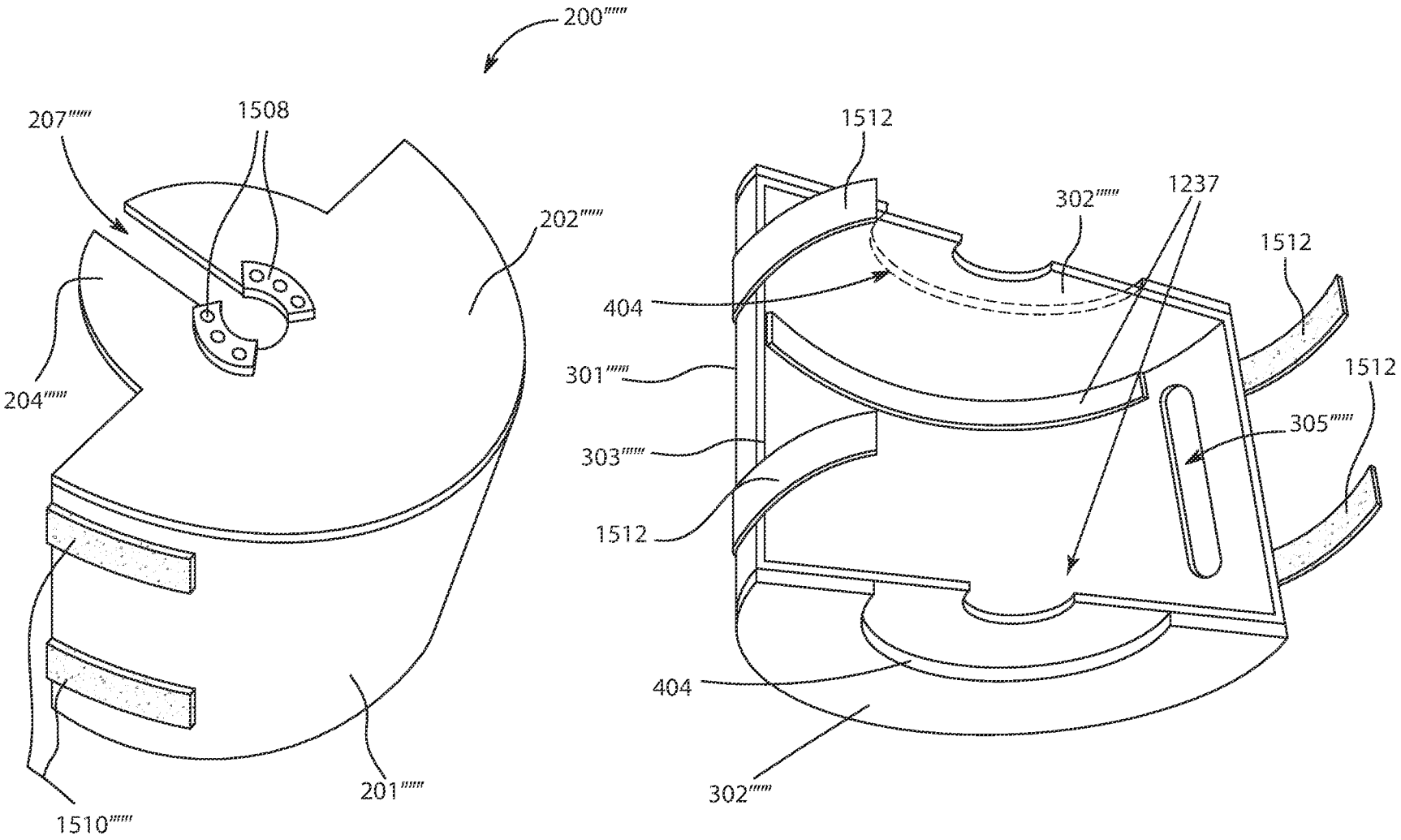
FIG. 19 is a perspective view of first and second cover portions of a disposable wire spool cover (shown apart but adapted for being mated together) showing central aperture reinforcements for better accommodating shafts of wire spool caddies, and showing portions of connector portions (i.e., comprised of double-sided tape strips, or hook material of a hook and loop fastener system strips) for holding cover portions together on a spool of wire on a shaft.

Referring to FIG. 19, there is shown a perspective view of first and second spool cover portions 200''''', 300''''', respectively, of a disposable wire spool cover 100''''' showing central aperture reinforcements for better accommodating shafts of wire spool caddies, and showing connector portions 1510, 1512 (i.e., comprised of double-sided tape strips, or hook material of a hook and loop fastener system strips) for holding the cover portions together on a spool of wire 700 on a shaft 800.

The first cover portion 200''''' comprises an outer wall 201''''', side walls 202''''', centrally aligned reinforcement portions 1508, or collett portions 1508, adapted for reinforcing attachment of the cover portion to a shaft 800 while covering a wire spool 700, and connector portions 1512.

The second cover portion 300''''' comprises an outer wall 301''''', side walls 302''''', and opening 304''''', and connector portions 1510. The connector portions 1510, 1512 may preferably be comprised of hook and loop fastener system strips for easy attachment to each other while holding the cover portions 200''''', 300''''' around a spool of wire 700 and installed on a shaft 800.

Similar to the spool cover 100''''', it will be appreciated that any of the spool covers 100, 100', 100'', 100''', 100'''', and as shown in FIG. 17, spool cover 100''''', may further comprise a plurality of durable reinforcements 1237 installed on an inside surface of the outer walls 301'''' of each of the first and second cover portions (but primarily on whichever portion is designed to be below the spool 700 since that is the portion on which the spool will likely rub the most) to reinforce the outer wall material, whether plastic, or cardboard, or other material, against tearing or other wear damage from engaging with the spool 700 during operation. It will further be appreciated that wear may be prevented by using a more durable outer material, including even possibly metal if necessary.

Figure 18:
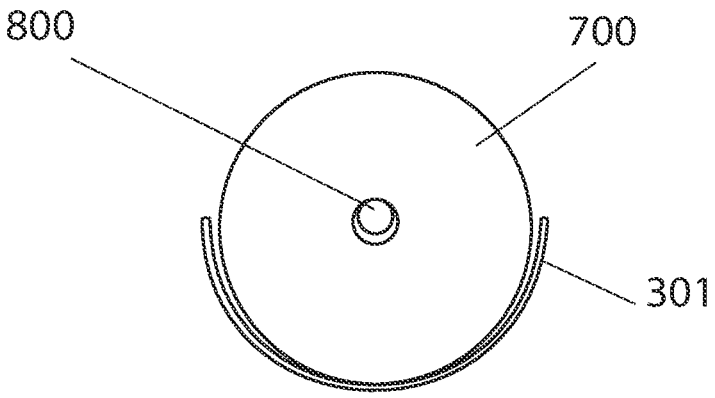
FIG. 18 is a side-view illustration showing how a wire spool side member may rest on the outer wall of the spool cover.

It will be appreciated, that the flanges of a spool 700 may rest on, for example, an inner part of the outer wall 301 (as shown in FIG. 18), with the flanges of the spool closely adjacent the side walls 202, 302 of the spool cover—the side walls are not shown in FIG. 18 to allow seeing how the flanges rub on the inner portion of the outer wall 301 during use. Thus, it will be appreciated that, depending on how heavy a particular wire spool 700 is, it may be desirable to adjust the colletts of the cover to have the wire spool move freely relative to the shaft 800, but with the flanges of the spool in contact with the cover, to control how fast the wire spool spins relative to the cover portions during installation of wire. Otherwise, if the wire spool 700 does not contact the outer wall 301 of the second, or bottom, cover portion, the spool would spin too fast, and it may thus become tangled. So, having it rub on durable reinforcements 1237 may be desirable to prevent undue spinning and tangling, as well as undue wear and tear on the outer wall 301.

As to the method of attachment and use, since, in an embodiment shown in FIG. 17, the collett portions 1208 are bonded to, for example, the side walls 302'''' (either by gluing, riveting, or even bolting if necessary for heavier spools 700), the cover portion 300'''' is preferably installed first at the bottom of the spool 700 on a shaft 800. Then, the upper collett portions 1210 are tightened down onto the shaft and into the aligned threaded holes 1212 of collett portions 1208 until the collett portions are snug on the shaft and, in effect, the bottom portion 300'''' of the spool cover 100'''' is supporting the weight of the spool through the collett portion 1208 bonded to the cover portion 300'''' even as the upper cover portion 200'''' is installed with ridges 208 nesting in holes 308. Again, in this way the spool 700 is allowed to spin on the shaft, while the colletts hold the cover portions in place relative to the shaft, and the spool is not allowed to spin too fast since it rubs on the durable reinforcement 1237 during operation, all to prevent tangling of wire 703 as it is dispensed. It will be appreciated that different collett systems may be used with different spool covers, whether 100, 100', 100'', 100''', 100'''', 100''''', or 100'''''', without departing from the scope of the invention as claimed.

It will be further appreciated that this invention provides the installer of wire from a wire spool mounted on a shaft the ability to work quickly, pull the wire from the spool with vigorous force without creating tangles in the wire at the spool, reducing the need to interrupt the installation work to clear the tangles.

Further, it will be appreciated that various wire spool covers are provided, some rebuildable to allow flexibility and versatility in meeting larger commercial wiring jobs, whereas disposable wire spool covers (e.g., made out of cardboard or other disposable material) are also provided for more limited use situations where disposal of the cover after use makes more sense.

While preferred embodiments of the present invention have been shown and described, it will be apparent to those skilled in the art that many changes and modifications may be made without departing from the invention in its broader aspects. For example, it will be appreciated that one of ordinary skill in the art may mix and match the various components of the various embodiments of the invention without departing from the true spirit of the invention as claimed. The appended claims are therefore intended to cover all such changes and modifications as fall within the true spirit and scope of the invention.

What is claimed is:

1. A wire spool cover adapted for covering at least a portion of a spool of wire, wherein the spool has opposing sides and a central hollow tube forming the spool, the spool adapted to be mounted on a shaft with the shaft passing through the central hollow tube, the inner diameter of the spool central hollow tube being larger than the diameter of the shaft, the wire spool cover adapted for preventing tangling of the wire during use of the spool of wire on the shaft, comprising:

A first cover portion adapted to partially encompass a portion of the spool of wire, said first cover portion comprising an outer wall and first and second side walls perpendicularly attached to the first cover portion's outer wall;

A second cover portion adapted to partially encompass another portion of the spool of wire, said second cover portion comprising an outer wall and first and second side walls attached to the second cover portion's outer wall, said first cover portion's side walls at least partially overlapping with said second cover portion's side walls when they are installed to cover the spool, the side walls engaging with each other to hold said first and second cover portions in position relative to each other when installed on the shaft to cover the spool, wherein the first and second side walls of at least one of said cover portions are adapted to attach to the shaft adjacent opposing sides of the spool of wire without removing the spool of wire from the shaft, wherein the first and second side walls of at least one of said cover portions are each adapted with a slit that is contiguous with an aperture in the center of each of the side walls, the first and second side walls of one of said cover portions also having an aperture in the center of each of the side walls, and wherein the apertures of the first and second side walls of each said first cover portion and said second cover portion are of a diameter to accommodate the diameter of the shaft to engage the shaft to at least partially cover the spool; and At least one collett portion adjacent and attached to each of the side walls of one of said cover portions, a first one of said at least one collett portion having an opening at least partially aligned with the aperture in the center of a side wall of the at least one cover portion, said at least one collett portion having a plurality of threaded through holes adapted for receiving and retaining a corresponding plurality of set screws adapted for tightening at varying locations relative to the shaft when said at least one cover portion is installed on the shaft, to help keep the spool and said first and second cover portions centered on the shaft as the spool spins on the shaft within the first and second spool cover portions to dispense wire without the wire becoming tangled.

2. The wire spool cover of claim 1, wherein said at least one collett portion comprises a plurality of corresponding collett portions adjacent each side wall of said second cover portion, each collett portion of each plurality of corresponding collett portions having an intermediate contact surface adapted to engage with at least one intermediate contact surface of another collett portion of the corresponding collett portions, each collett portion of each plurality of corresponding collett portions defining a plurality of threaded through holes, each threaded through hole being adapted for being aligned with a threaded through hole of another collett portion of the corresponding collett portions and adapted for receiving a set screw through aligned threaded through holes of corresponding collett portions for tightening each of the corresponding collett portions onto the shaft, each collett portion of each of said plurality of corresponding collett portions defining an opening adapted to partially encircle the shaft when the corresponding collett portions are installed on the shaft, wherein one collett portion of each of the corresponding collett portions is attached to a side wall of one of said first and second cover portions with the opening of the attached one collett portion being at least partially aligned with the aperture in the center of the side wall to which the one collett portion is attached, and wherein another of the corresponding collett portions is adapted to be attached via the set screws to said first collet portion with at least one of each of the collett portions' mating intermediate surfaces being in contact and with at least one threaded through hole of each of the collett portions thus in contact being aligned so that the openings of the collett portions thus in contact at least partially enclose around the shaft, said plurality of corresponding collett portions combined being adapted for maintaining the spool centered on the shaft and relative to the first and second spool cover portions as the spool spins on the shaft within the first and second spool cover portions to dispense wire without the wire becoming tangled.

3. The wire spool cover of claim 2, wherein said plurality of corresponding collett portions comprises a pair of first and second collett portions, each said first collett portion being attached to a corresponding different side wall of said at least one of said first and second cover portions, each said first and second collett portion defining threaded through holes and having intermediate surfaces adapted to engage when the first and second cover portions are covering a spool and when said first and second collett portions are installed on the shaft, the through holes of each said first and second collett portion being aligned and therefore adapted to receive a corresponding plurality of set screws passing through the aligned through holes to secure each said first and second collett portion together in mating pairs and to secure the pair of first and second collett portions to the shaft, each said first and second corresponding collett portion combined being adapted for maintaining the spool centered on the shaft and relative to the first and second spool cover portions as the spool spins on the shaft within the first and second spool cover portions to dispense wire without the wire becoming tangled.

4. The wire spool cover of claim 3, wherein one of said first cover portion and said second cover portion further comprises an opening on the outer wall of one of the cover portions adapted for allowing the wire on the spool to pass through the outer wall, allowing the spool of wire to rotate freely on the shaft while encompassed by the spool cover to dispense the wire in a tangle-free manner from the spool as it passes through the opening.

5. The wire spool cover of claim 4, wherein the opening is defined in the outer wall of said second cover portion, and wherein the opening is an elongated capsule shape.

6. A wire spool cover adapted for covering at least a portion of a spool of wire, wherein the spool has sides and a central hollow tube forming the spool between the sides, the spool adapted to be mounted on a shaft with the shaft passing through the central hollow tube, the wire spool cover adapted for preventing tangling of the wire during use of the spool of wire on the shaft, comprising:

A first cover portion adapted to partially encompass a portion of the spool of wire, said first cover portion comprising an outer wall and first and second side walls perpendicularly attached to the first cover portion's outer wall;

A second cover portion adapted to partially encompass another portion of the spool of wire, said second cover portion comprising an outer wall and first and second side walls attached to the second cover portion's outer wall, said first cover portion's side walls at least partially overlapping with said second cover portion's first and second side walls when the first and second cover portions are installed to at least partially cover the spool on the shaft, the side walls engaging with each other to aid in holding said first and second cover portions in position relative to each other to cover the spool when the first and second cover portions are installed on the shaft, wherein the first and second side walls of one of said first and second cover portions are each adapted with a slit that is contiguous with an aperture in the center of each of the first and second side walls of said at least one cover portion, wherein the first and second sidewalls of another of said first and second cover portions are adapted with an aperture of a diameter to accommodate the diameter of the shaft, wherein the first and second side walls of one of said first and second cover portions are adapted to be installed to engage the shaft adjacent opposing sides of the spool of wire without removing the spool of wire from the shaft to at least partially cover the spool and to allow dispensing of wire without the wire becoming tangled;

A plurality of attachment member portions adapted to releasably interconnect said first and second cover portions, at least one attachment member portion attached to said first cover portion and at least one other attachment member portion attached to said second cover portion, each of said plurality of attachment member portions adapted to be releasably attached with a corresponding one other of said plurality of attachment member portions to help hold the first and second cover portions in position covering the wire spool on the shaft.

7. The wire spool cover of claim 6, further comprising a plurality of reinforcing collett portions, the reinforcing collett portions adapted for being attached to and shaped to be substantially coextensive with the apertures of the first and second side walls of said first cover portion to reinforce installation of said first cover portion on the shaft and also adapted to reinforce installation of said second cover portion relative to the shaft when said first cover portion and said second cover portion are releasably attached to each other with said plurality of attachment member portions and are installed around the shaft to cover the spool.

8. The wire spool cover of claim 6, wherein said plurality of attachment member portions comprise a plurality of strips of paired hook and loop attachment member material with at least one strip attached to said first cover portion and at least one other strip attached to said second cover portion, adapted for releasably interconnecting said first and second cover portions to each other when installed to at least partially cover a wire spool on a shaft.

9. The wire spool cover of claim 6, wherein said second cover portion further comprises an opening on the outer wall adapted for allowing the wire on the spool to pass through the outer wall of said second cover portion, allowing the spool of wire to rotate freely on the shaft while encompassed by said spool cover to dispense the wire in a tangle-free manner from the spool as it passes through the opening.

10. The wire spool cover of claim 9, wherein the opening on the outer wall of said second cover portion is an elongated capsule shape.

11. The wire spool cover of claim 6, wherein said first and second cover portions are more readily disposable and recyclable being constructed of cardboard.

12. The wire spool cover of claim 11, further comprising a plurality of durable reinforcements installed on an inside surface of the outer walls of each of said first and second cover portions to reinforce the cardboard material against tearing or other wear damage from engaging with the spool during operation.

13. The wire spool cover of claim 11, wherein the plurality of collett portions are comprised of one of rubber and plastic.

14. A wire spool cover adapted for covering at least a portion of a spool of wire, wherein the spool has sides and a central hollow tube forming the spool, the spool adapted to be mounted on a shaft with the shaft passing through the central hollow tube, the inner diameter of the spool central hollow tube being larger than the diameter of the shaft, the wire spool cover adapted for preventing tangling of the wire during use of the spool of wire on the shaft, comprising:

A first outer wall having opposing side edges and opposing front and back edges;

A second outer wall having opposing side edges and opposing front and back edges;

A plurality of removable edge connectors, each defining a plurality of screw holes spaced around a periphery of each edge connector, and each edge connector being attached as by gluing, riveting, or screws, to a side edge of corresponding said first and second outer walls;

A plurality of side wall members, each said side wall member defining a plurality of screw holes and adapted to be aligned with the screw holes of corresponding ones of said plurality of removable edge connectors, wherein said side wall members are adapted for removable installation on and perpendicular to the side edges of corresponding ones of said first and second outer walls, wherein when interconnected with said first and second outer wall members to form first and second cover portions, the first cover portion's first and second side walls are adapted to be at least partially overlapping with the second cover portion's first and second side walls when they are installed to cover the spool, the side walls engaging with each other to hold said first and second cover portions in position relative to each other when installed on the shaft to cover the spool, wherein the first and second side walls of at least one of said first and second cover portion are adapted to attach to the shaft adjacent opposing sides of the spool of wire without removing the spool of wire from the shaft, wherein the first and second side walls of at said at least one of said first and second cover portion are each adapted with a slit that is contiguous with an aperture in the center of each of the first and second side walls of said first cover portion, wherein the first and second side walls of another of the first and second cover portions also define a central aperture, the apertures of the first and second side walls of corresponding first and second cover portions each being of a diameter to accommodate the diameter of the shaft, the first and second side walls of one of the first cover portion and the second cover portion being installable on the shaft to at least partially cover the spool, said first and second outer walls being screwed to corresponding ones of the first and second side wall members, wherein at least one of the side wall members is removable from at least one of the corresponding first and second outer walls to facilitate refurbishing of side walls and or outer walls after they become worn during use to prevent tangling of wire as it is being dispensed through the spool.

15. The wire spool cover of claim 14, wherein said side walls of the second cover portion at least partially overlap with the side walls of the first cover portion when combined to form the spool cover, and at least one of said side walls of the one of said first and second cover portions further comprises at least one depression and at least one of said side walls of the other of said first and second cover portions further comprises at least one ridge, wherein the at least one ridge matingly fits into the at least one depression when said side walls are aligned and overlapped to keep the first cover portion and the second cover portion aligned and together while covering the spool.

16. The wire spool cover of claim 15, wherein the at least one depression comprises a plurality of holes and the at least one ridge comprises bolt heads.

17. The wire spool cover of claim 15, wherein at least one of said first and second side walls of one of said first and second cover portions further comprise particularly shaped protrusions, and one of said first and second side walls of another of said first and second cover portions comprise particularly shaped mating portions, wherein the particularly shaped mating portions and the particularly shaped protrusions are complementarily shaped, wherein the particularly shaped protrusions matingly fit into the complementarily shaped mating portions when the first cover portion and the second cover portion are aligned such that the first cover portion and the second cover portion are combined to form the spool cover.

18. The wire spool cover of claim 14, wherein at least one side wall of said first and second side walls of one of said first and second cover portions, and wherein at least one side wall of another of said first and second side walls of another of said first and second cover portions, further comprises a handle.

* * * * *